US012546085B2

(12) United States Patent
Homsi et al.

(10) Patent No.: US 12,546,085 B2
(45) Date of Patent: Feb. 10, 2026

(54) SUBSTRATE FOUNDATION SUPPORT

(71) Applicant: Parsons Corporation, Centreville, VA (US)

(72) Inventors: Elie Habib Homsi, Spicewood, TX (US); Vincent T. Gastoni, Cambridge, MN (US); Brian K. Witte, Westminster, CO (US)

(73) Assignee: Parsons Corporation, Charlotte, NC (US)

( * ) Notice: Subject to any disclaimer, the term of this patent is extended or adjusted under 35 U.S.C. 154(b) by 261 days.

(21) Appl. No.: 18/403,413

(22) Filed: Jan. 3, 2024

(65) Prior Publication Data

US 2024/0254716 A1 Aug. 1, 2024

Related U.S. Application Data

(60) Provisional application No. 63/481,923, filed on Jan. 27, 2023.

(51) Int. Cl.
*E02D 27/28* (2006.01)

(52) U.S. Cl.
CPC ..... *E02D 27/28* (2013.01)

(58) Field of Classification Search
CPC ..... E02D 27/28
See application file for complete search history.

(56) References Cited

U.S. PATENT DOCUMENTS 2,468,729 A * 5/1949 Black ..... E02D 5/806 52/155
3,974,604 A * 8/1976 Conn ..... E02D 5/805 405/244
6,435,777 B1 * 8/2002 Yoshii ..... E02D 5/36 405/231
7,695,218 B2 * 4/2010 Maione ..... E02D 3/08 405/269

FOREIGN PATENT DOCUMENTS

JP H08165643 A * 6/1996
JP 2020143491 A * 9/2020
JP 2022035178 A * 3/2022

* cited by examiner

*Primary Examiner* — Kyle Armstrong
(74) *Attorney, Agent, or Firm* — Martensen IP; Michael C. Martensen

(57) ABSTRACT

Lateral extensions enhance the capacity and stability of a foundation element by penetrating the surrounding substrate creating a stronger underpinning. The load bearing capacity of a foundation element is increased by deploying extensible components into the surrounding substrate/soil. The breadth of a foundation element is expanded by extending components into the surrounding soil via an expansion mechanism integrated within a foundation element or piling and deployed into the surrounding substrate once the foundation element is positioned in the ground.

38 Claims, 17 Drawing Sheets

SUBSTRATE FOUNDATION SUPPORT

BACKGROUND OF THE INVENTION

Field of the Invention

Embodiments of the present invention relate to systems and methods to increase the capacities of underground foundations and more particularly with systems and methods for deploying supports into the adjacent substrate before, during or post installation of the foundation element.

Relevant Background

It is well known that current foundation elements have limited capacities to bear weight. Some of the main challenges faced on construction sites relate to the use of drilled shafts and driven piles to establish foundations. Foundations must often be installed in soils having inadequate capacity to bear the required structural loads which consequently require many foundation elements or very deep or large-diameter foundation elements. In addition, foundation installation often seeks to terminate a foundation within a relatively thin layer of adequate material, e.g., rock, or hard material that is sandwiched between two layers of less desirable materials such as soft soils or clay. Such soil conditions may require many foundation elements to mobilize the needed soil bearing capacity to carry the structure loads. Due to unfavorable soil conditions, more foundation elements must be drilled or driven deeper, and/or larger diameter shafts or piles must be used to develop the required capacities. Both approaches increase costs and involve higher risk and complexity. The result is a requirement to use larger equipment, deeper holes, larger rebar cages, more concrete, all of which carry a higher risk of structural failure, collapses during excavation, larger environmental impact, higher complexity of the installation, higher risk of accidents and problems during construction, and less room for redundancy. What is needed is a foundation support system and its associated methodology that provides increased foundation capacity and enhanced frictional soil interaction thereby reducing, for a stated capacity need, the number, depth, and size of the required foundation elements. These and other deficiencies of the prior art are addressed by one or more embodiments of the disclosed invention.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

A system and associated methodology for enhancing the capacity of foundation elements laterally penetrates the surrounding substrate creating a more stable and stronger underpinning. The load bearing capacity of a foundation element is increased by deploying extensible components, also referred to herein as outriggers, quills and fins, into the surrounding substrate/soil. The breadth of a foundation element is expanded laterally by extending quills or fins into the surrounding soil. Much like the roots of a tree, the quills and fins increase interaction with the substrate creating a larger area on which to distribute a load. The extensible components are integrated within the foundation element and the like and deployed into the surrounding substrate once the foundation element is positioned in the ground.

The disclosed methodology and associated system includes outriggers, fins, or quills deployed from the sides of a foundation element into the adjacent soil when installed in or near its final position. Deployment may occur either before, during or after concreting for the drilled shafts and after driving for the driven piles. The deployment may also occur, before or after the introduction of the partial or final building load on the foundation element. The deployed extensible components improve the foundation element's strength against mechanical shear, improve friction, and/or increase load-bearing capacity. As a result, the depth, size, and/or number of foundation elements can be reduced. The disclosed systems and methods can increase the capacity of foundation elements to resist downward loads and uplift forces as well as increase the lateral capacity of foundation elements. Responsive to the use of the disclosed invention, foundation efficiency, construction safety, building schedules, cost and environmental impact are improved. Moreover, foundation capacity enhanced from employing the present invention can be tested and verified in the field prior to final loading.

In one embodiment of the present invention a foundation support apparatus includes a foundation element within a substrate having a length along a longitudinal axis. Within the foundation element is an expansion mechanism integrated within an outer dimension of the foundation element that is coupled to an extensible component. The expansion mechanism is configured to extend a portion of the extensible component outside the outer dimension of the foundation element to an extended configuration thereby penetrating the substrate.

Other features of the foundation support apparatus include that the expansion mechanism may be aligned with or offset from a central longitudinal axis. In one embodiment two or more extensible components are independently coupled to one or more expansion mechanism(s). In one instance two extensible components are opposingly coupled to the expansion mechanism. While a variety of orientations and distributions of the expansion mechanisms and associated extensible components within the foundation element are possible and contemplated, in one instance of the present invention a portion of extensible components is configured to penetrate the substrate at an angle less than 90 degrees as measured from a distal end of the foundation element relative to the longitudinal axis. In another instance a portion of extensible components is configured to penetrate the substrate at an angle greater than 90 degrees as measured from a distal end of the foundation element relative to the longitudinal axis.

In another embodiment of the present invention the extensible component includes an inner component and an outer component, wherein the outer component is hollow having an outer component interior dimension and wherein an inner component exterior dimension is less than the outer component interior dimension, the inner component being movable within the outer component. A fluid source is coupled to the expansion mechanism and channeled to an interior portion of the outer component thereby creating a pressure gradient translating the inner component within the outer component to the extended configuration.

In one version of the present invention, the foundation element includes reinforcement bars (rebar) configured into a rebar cage. A void exists between the substrate and an outer dimension of the rebar cage and between the reinforcement bars of the rebar cage. In this version a matrix such as concrete is configured to occupy the void and integrate with the rebar cage responsive to the portion of the extensible component being in the extended configuration. In another version of the invention the matrix is configured to occupy the void and integrate with the rebar cage prior to or concurrently with the portion of the extensible component being in the extended configuration.

The present invention includes expansion mechanism that are electrically, hydraulically, mechanically, and chemically driven. Another feature of the invention is that the portion of the extensible components when in the extended configuration includes a grout. The grout is configured to occupy an area void of material between the extensible components penetrating the substrate and the substrate itself.

In yet another embodiment of the present invention, the extensible component include a projection proximate to an exterior surface of the foundation element that is substantially aligned with the longitudinal axis of the foundation element when in a nonextended configuration. The projection includes a first end rotatably coupled to the foundation element and a second end associated with the expansion mechanism. When the expansion mechanism moves the extensible component into its extended configuration the second end is angularly offset about the first end thereby penetrating substrate.

In another embodiment of the present invention support of a foundation element is established by integrating an expansion mechanism within a foundation element. The method continues by coupling an extensible component to the expansion mechanism and thereafter establishing the foundation element within a substrate. Once placed into the substrate, a portion of the extensible component is extended outside of an outer dimension of the foundation element penetrating the substrate.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The features and objects of the present invention and the manner of attaining them will become more apparent, and the invention itself will be best understood, by reference to the following description of one or more embodiments taken in conjunction with the accompanying drawings, wherein.

Figure 1A:
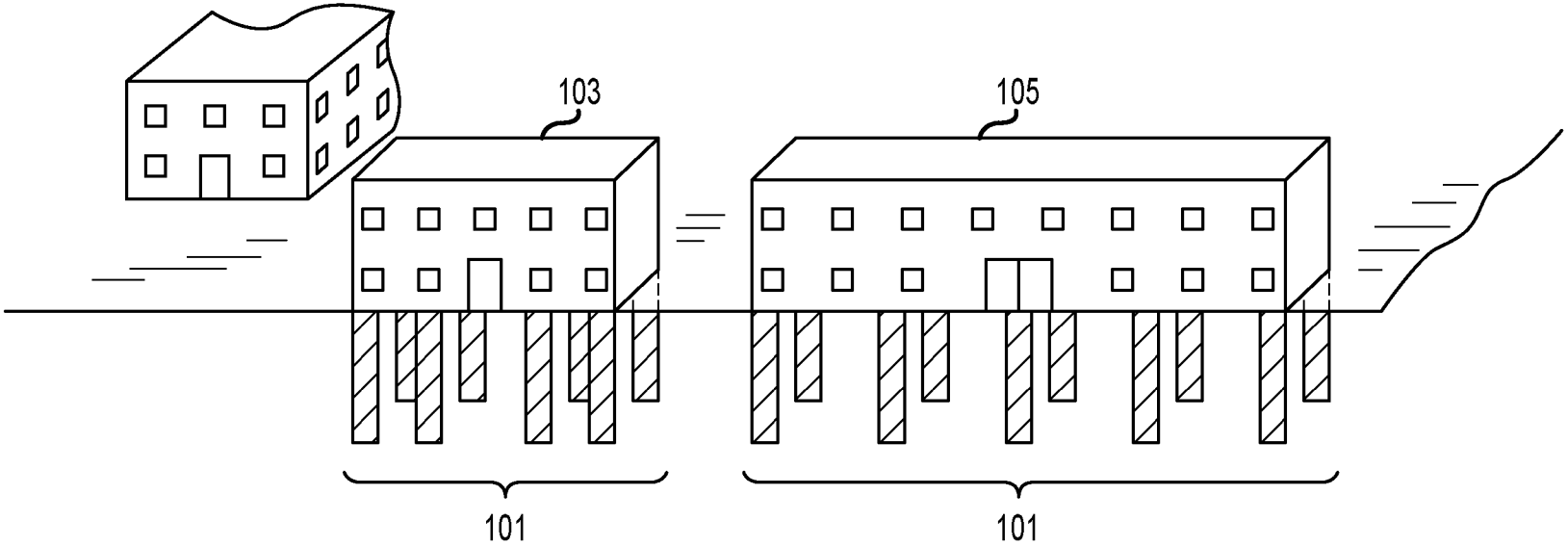
FIGS. 1A-1E present a high-level view of a foundation element associated with a structure and its associated loading employing one or more embodiments of the lateral substrate support system of the present invention.

The Figures depict embodiments of the present invention for purposes of illustration only. Like numbers refer to like elements throughout. In the figures, the sizes of certain lines, layers, components, elements, or features may be exaggerated for clarity. One skilled in the art will readily recognize from the following discussion that alternative embodiments of the structures and methods illustrated herein may be employed without departing from the principles of the invention described herein.

DESCRIPTION OF THE INVENTION

The capacity and stability of a foundation element is enhanced by lateral extensions that penetrate the surrounding substrate creating a more stable and stronger underpinning. The load bearing capacity of a foundation element is increased by deploying extensible components of the present invention, also referred to herein as quills and fins, into the surrounding substrate/soil. The breadth of a foundation element is expanded by extending quills or fins (extensible components) into the surrounding soil via an expansion mechanism. The quills and fins of the present invention increase interaction with the substrate creating a larger area and rougher surface with lateral deformation on which to distribute a load. The extensible components are integrated within a foundation element, and the like, and deployed into the surrounding substrate once the foundation element is positioned in the ground.

Embodiments of the present invention are hereafter described in detail with reference to the accompanying Figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description includes various specific details to assist in understanding the present invention but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Accordingly, the terminology used herein is for the purpose of describing embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with, or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

By the term "foundation" it is meant a part of a structure, building or bridge that supports and anchors the structure above it and transfers its weight to the ground. There are different types of foundations, depending on the design of the structure the soil conditions, the site conditions, and the budget. Drilled shafts, shafts, caissons, drilled caissons, drilled piles, drilled piers, bored shafts, bored piles, cast-in-drilled-hole piles, CIDH, replacement piles, slurry wall panels, barrettes, and the like are foundations that are constructed by excavating the soil, before installing rebar (if needed) and/or pouring concrete creating the foundation. These types of foundations can have various geometric shapes including round, square or rectangular cross sections. Excavation for this type of foundation can be accomplished using dry holes, bentonite slurry, polymer slurry, casings or other similar methods.

What is meant by a "substrate" is something that lies beneath or supports something else. In a construction context a substrate is any material that exists or is extracted from beneath the topsoil, and that is used to support or incorporate into the structure. Some examples of substrates are organic soils, sand, silt, clay, rock, and gravel. The type of substrate affects the design and selection of the foundation, which is the part of the structure that transfers its load to the ground. Different substrates have different properties, such as strength, stability, moisture, and compressibility, that influence how well they can support the structure and prevent it from sinking, tilting, or cracking.

What is meant by a "foundation casing" is a type of exterior or sheath that is used to support and stabilize the excavation of a drilled shaft or a caisson foundation. These casings are used to prevent collapse during the drilling and excavation stages prior to concreting. Alternatively, Drilling fluids, Bentonite slurry, Polymer slurry or other means could be used to stabilize the excavation. When a casing is to remain after the concreting, provisions for lateral holes or windows will be implemented to enable the extension of the extensible components of the present invention into the substrate.

What is meant by an "expansion mechanism" is a process or a device that causes something to increase in size, volume, or extent. There are different types of expansion mechanisms, depending on the context and the purpose.

What is meant by an "extensible component" is structure or item that is capable of being extended or having the ability to be extended. Extensible is used to describe things that can be modified or adapted to suit a need. For example, an extensible web browser can be customized with different extensions or plugins that add new features or functions. With respect to physical objects as in the present invention extensible is used to describe materials that can be stretched or expanded. For example, an extensible measuring tape can be pulled out to measure different lengths. An extensible fabric can be stretched to fit different shapes or sizes. An extensible tongue can be protruded to reach different distance. Extensible components may change in size/length from a first length to a second length, the second length being larger than the first length.

What is meant by a "foundation element" is a structural element that supports the weight of a structure (building, bridge, or the like) and transfers that load to the surrounding soil. A foundation element may comprise the rebar cage (where used), the post tensioning strand (where used), the concrete and the post grouting (when used). Rebar, short for "reinforcing bar" or "reinforcement bar", is a metal bar that is used to help increase the strength of concrete. As a result, it helps concrete structures withstand tensile, bending, torsion, and shearing load. The foundation element of the present invention can be cast in place in and around a rebar cage in an excavated hole or precast/prefabricated and driven in the ground. A foundation footing is a block of concrete or other material that is placed proximate to the ground surface, basement level or as specified by the design to distribute the load over a larger area and to distribute the loads to the one or more foundation elements. A foundation element can be made of different materials, such as concrete, steel, wood, or masonry, depending on the design requirements.

What is meant by a "rebar cage" is a steel framework that is used to reinforce concrete structures, such as foundations, foundation elements, beams, walls, and bridges. A rebar cage is made of longitudinal bars that run along the length of the structure, transverse bars, diagonal bars and spirals that wrap around the longitudinal bars at regular intervals. The bars are usually connected by wire ties, clamps, or welds. A rebar cage provides strength to a concrete structure, and helps it resist various forces, such as compression, tension, bending, and shear.

What is meant by a "driven pile" or "pile" or "piling" is a type of foundation used to support a structure by transferring its load to a deeper and more stable layer of soil or rock. A piling is usually a long and slender foundation element that is made of timber, steel, concrete, or a combination of these materials. In most instances, including that of the present invention, pilings include a post tension strand or strands. Post-tensioning is a method of reinforcing (strengthening) concrete or other materials with high-strength steel strands or bars, typically referred to as tendons. A piling can be driven, or jetted, into the ground, depending on the site conditions and the design requirements. Piles or pilings may also be referred to as soldier piles, displacement piles, precast piles, pipe piles, square piles, hollow piles, and steel piles. Piles are prefabricated prior to driving or jetting them in the ground. In the case of hollow piles, the soil inside the hollow pile could be excavated prior to pouring concrete if needed, these could be round, square, or rectangular cross section. Screw piles or continuous auger piles are a subset of the drilled shaft type of foundations that are constructed by pouring/pumping the concrete while excavating the soils and then installing the rebar cages if need before the concrete hardens. The present invention is applicable to all these types of foundations elements.

Included in the description are flowcharts depicting examples of the methodology which may be used to provide lateral support of a foundation. In the following description, it will be understood that each block of the flowchart illustrations, and combinations of blocks in the flowchart illustrations are processes that can be implemented by various means. The blocks of the flowchart illustrations support combinations of means for performing the specified functions and combinations of steps for performing the specified functions. It will also be understood that each block of the flowchart illustrations, and combinations of blocks in the flowchart illustrations, can be implemented by special purpose hardware or systems that perform the specified functions or steps, or combinations of special purpose hardware.

Upon reading this disclosure, those of skill in the art will appreciate still additional alternative structural and functional designs for a system and a process for lateral support of foundation elements through the disclosed principles herein. Thus, while embodiments and applications have been illustrated and described, it is to be understood that the disclosed embodiments are not limited to the precise construction and components disclosed herein. Various modifications, changes, and variations, which will be apparent to those skilled in the art, may be made in the arrangement, operation and details of the method and apparatus disclosed herein without departing from the spirit and scope defined in the appended claims.

Establishing a foundation is a crucial step in the construction of any building or structure, serving several essential purposes. The primary purpose of a foundation is to support the entire weight of the building or structure, transferring the load to the underlying soil or rock. It ensures that the structure remains stable and does not settle or collapse under its own weight or external forces such as wind, earthquakes, or other loads. Foundations provide a stable base for the construction of the superstructure (above-ground portion of the structure). This is crucial for ensuring that the piers, decks, floors, walls, and other structural elements remains as designed, providing a safe and comfortable environment for the end users.

In addition to vertical loads, foundations must also resist horizontal forces such as wind, seismic activity, unbalanced earth loads, and soil pressure. Specialized foundation designs, such as shear walls and pilings, help to counteract these lateral forces and enhance the overall stability of the structure.

The size and depth of a foundation are determined by several factors related to the building, site conditions, and the properties of the soil. The type and bearing capacity of the soil at the construction site are crucial factors. Different soils have varying abilities to support loads. The weight of the building, including the dead load (the weight of the structure itself) and live loads (occupant loads, furniture, equipment, wind, seismic, vehicles, dynamic loads, unbalanced earth loads, etc.), directly influences the size and depth of the foundation. Heavier structures require larger and deeper foundations.

Different types of foundations have varying size and depth requirements. For example, shallow foundations (e.g., spread footings) are used when the soil can adequately support the loads near the surface. Deep foundations (e.g., drilled shafts, driven piles) are employed when the soil near the surface is not suitable, and load-bearing capacity must be found deeper underground.

One aspect of the present invention is that it enhances, supplements, and expands upon the traditional mechanism of skin friction in the vertical walls of a shaft. The present invention enhances soil/foundation side friction in a competent substrate that cannot be normally realized through traditional means and thereby increasing the foundation capacity to minimize depth, risk, and cost.

While the invention is hereafter shown and described with reference to embodiments, it will be understood by those skilled in the art that various other changes in the form and details may be made without departing from the spirit and scope of the invention.

Figure 1B:
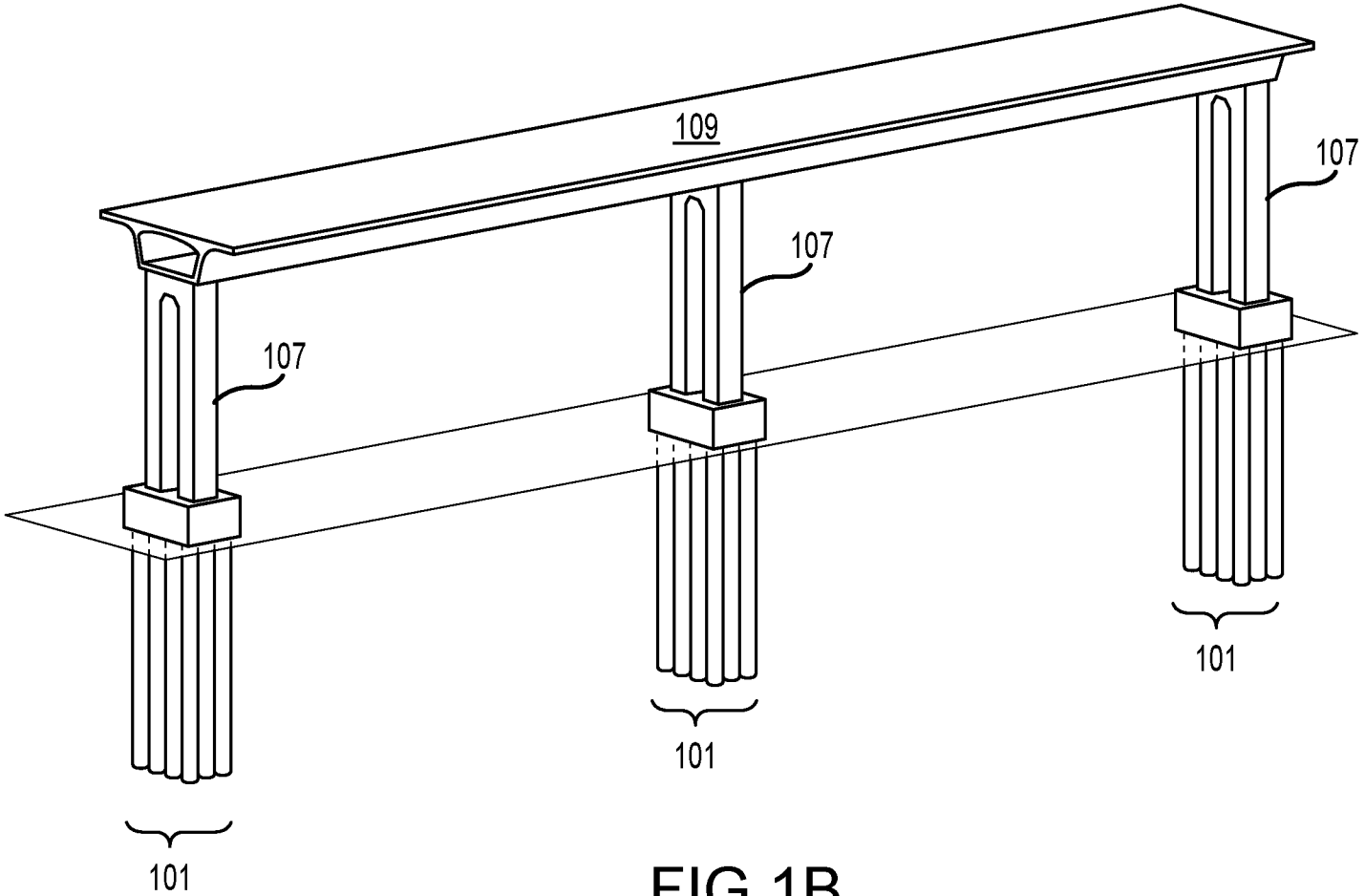
Figure 1C:
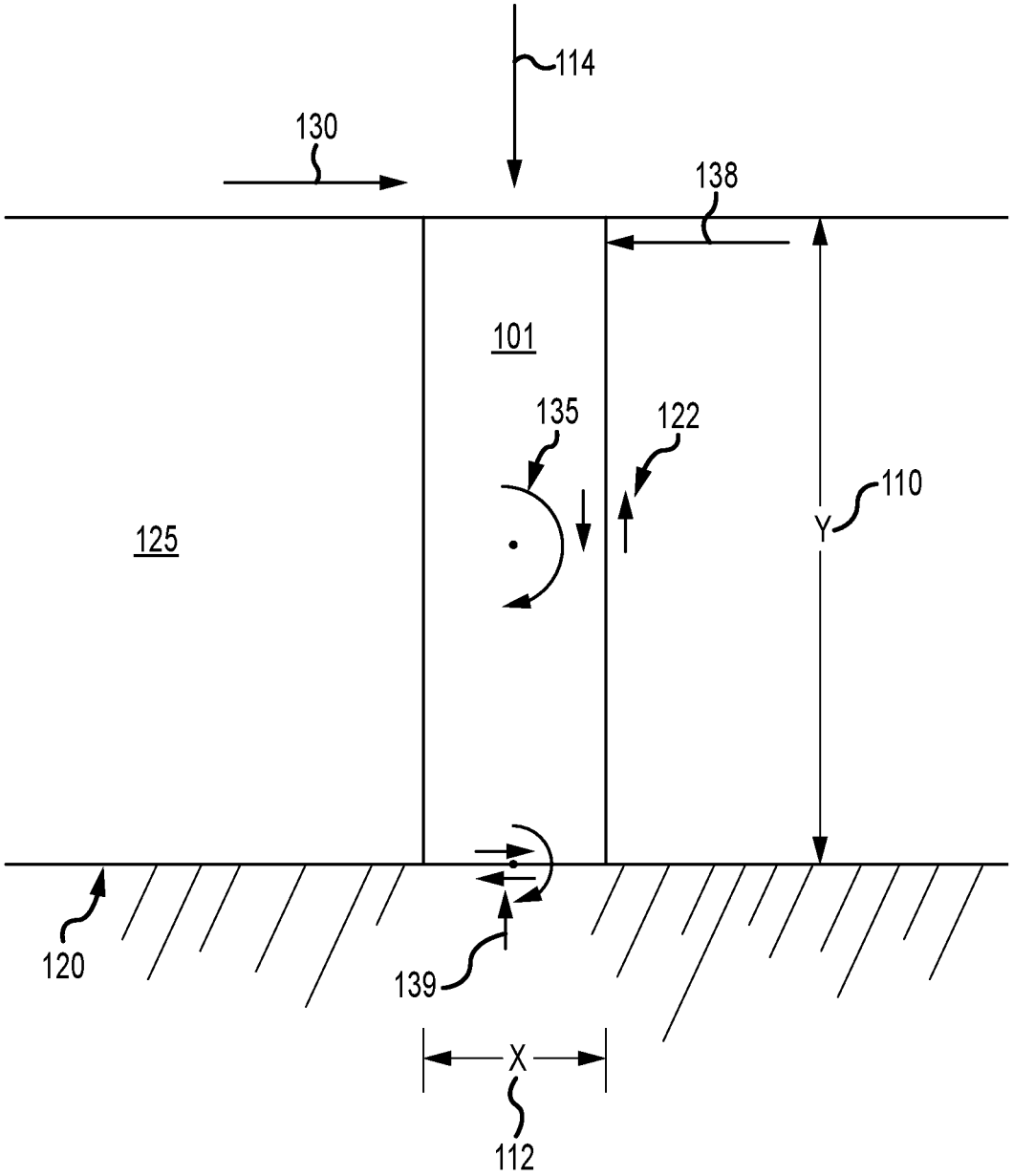

FIGS. 1A and 1B depict a front and side view of a building and bridge, respectively, supported by a foundation comprising a plurality of foundation elements. As discussed above, depending on the size of the structure and its static and dynamic weight parameters engineers can determine the number as well as the needed depth and width of each foundation element. FIG. 1A presents a plurality of foundation elements 101 underlying a building 103, 105 while FIG. 1B shows several foundation elements 101 supporting piers 107 in a bridge 109. One skilled in the relevant art will recognize the concepts presented herein with respect to foundation element support is applicable across a wide variety of structures. FIG. 1C presents a high-level load diagram for a foundation element 101 having a length Y 110 and a width X 112. A portion of the weight of the building presents a compressive force 114 downward through the foundation element 101. The force is opposed by the underlying ground 120 at the bottom of the foundation element 101 across its width X 112. In addition, there is a shear force 122 along the length Y 110 of the foundation element as the foundation element 101 interfaces with the surrounding substrate 125.

The foundation element 101 may also experience lateral loads 130. For example, wind blowing on the side of a tall building may increase the downward force due to a moment 135 but also invoke a lateral load. The lateral load 130 and the moment 135 realized by the lateral load are resisted by opposing forces 138 from the substrate along the foundation element's length Y 110. These loads, determined during the design of the building, are a significant factor is the size and depth of the foundation.

Figure 1D:
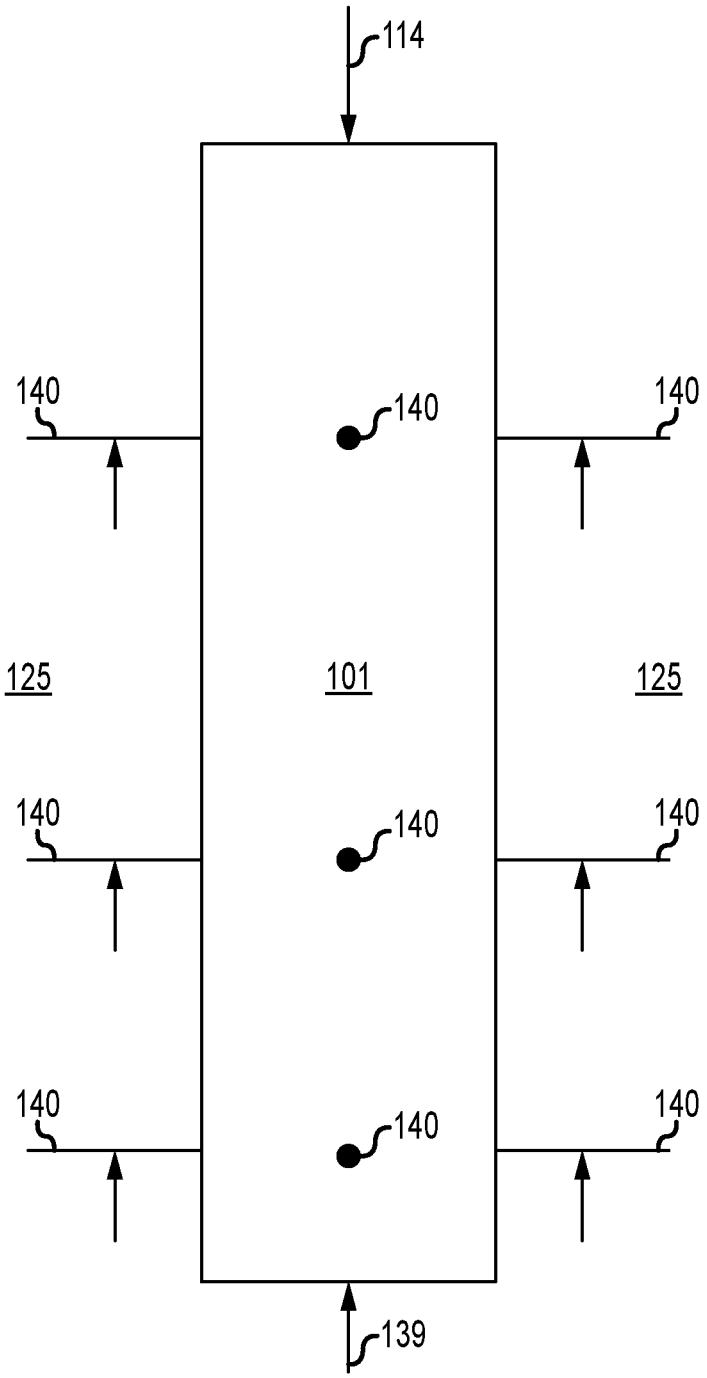

FIGS. 1D and E present, according to one embodiment of the present invention, a foundation element 101 employing a plurality of supports, also referred to herein as extensible components and/or quills and/or fins 140. The depiction in FIG. 1D shows the foundation element 101 first introduced in FIG. 1C under a compressive load 114. In this instance a plurality of extensible components 140 (quills) are extended laterally penetrating the substrate 125 at different depths along the length Y of the foundation element 101. Each extensible component 140, once extended, is fixedly coupled to the foundation element 101, and embedded into the substrate 125.

The portion of extensible component that extends into the substrate provides additional contact (interaction) with the underlying substrate providing additional mechanisms for load transfer. Rather than the entirety of the compressive load 114 being supported by the base or sides of the foundation element 101, one embodiment of the present invention enhances the foundation element's contact with the substrate 125 thereby providing additional regions at which the load can be transferred to the substrate. In FIG. 1D, twelve extensible components 140 are inserted into the substrate 125 from the foundation element 101, six shown laterally with three coming out of the page and three going into the page. One of reasonable skill in the art will recognize that configurations, orientations, shapes, and numbers of extensible components integrated into individual foundation element can vary as can configurations, orientations, shapes, and numbers of extensible components vary as between foundation elements.

The effect of including the supports shown in FIG. 1D is that the load capacity of a foundation element 101 is increased. Said differently, for the same capacity requirement, the size and depth of a foundation element embodying the lateral supports of the present invention can be decreased or for the same size and depth, the number of foundation elements can be decreased. This increase in load capacity results in saving, among other things, construction time and cost.

Figure 1E:
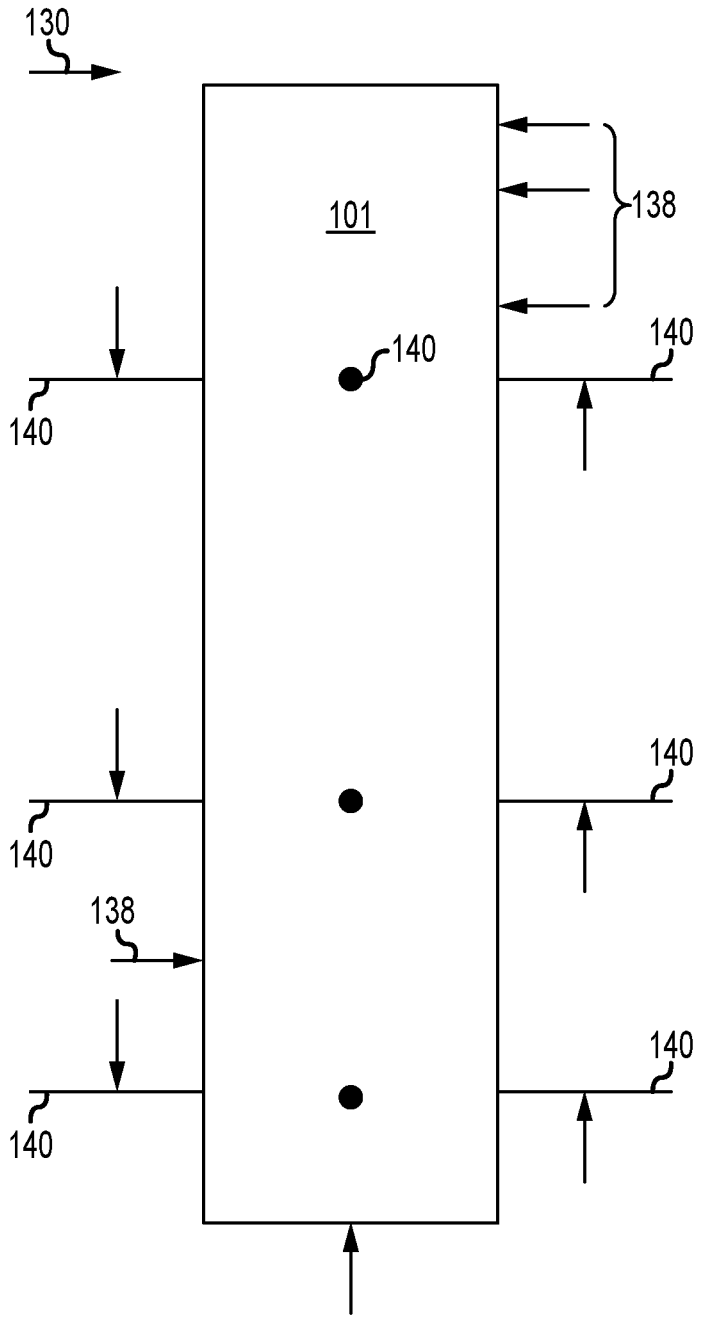

The lateral supports of the present invention also provide lateral load mitigation. FIG. 1E presents the foundation element 101 of FIG. 1C under a lateral load 130. The foundation element recognizes, in this example, a lateral load 130 at its top. The extensible components 140, fixedly attached to the foundation element 101, enhance the longitudinal surface area resistant of a lateral load. The extensible components opposite the load would experience a lateral resistance force to resist bending.

As with a compressive load, the lateral supports of the present invention increase the foundation element's ability to withstand a lateral load. Knowing a design required lateral load, a foundation element embodying one more lateral support of the present invention can reduce the size and/or number of foundation elements thereby reducing risk, cost, and time. Again, one of reasonable skill in the art will recognize that multiple configuration and numbers of extensible components can be integrated into each foundation element.

Figure 2A:
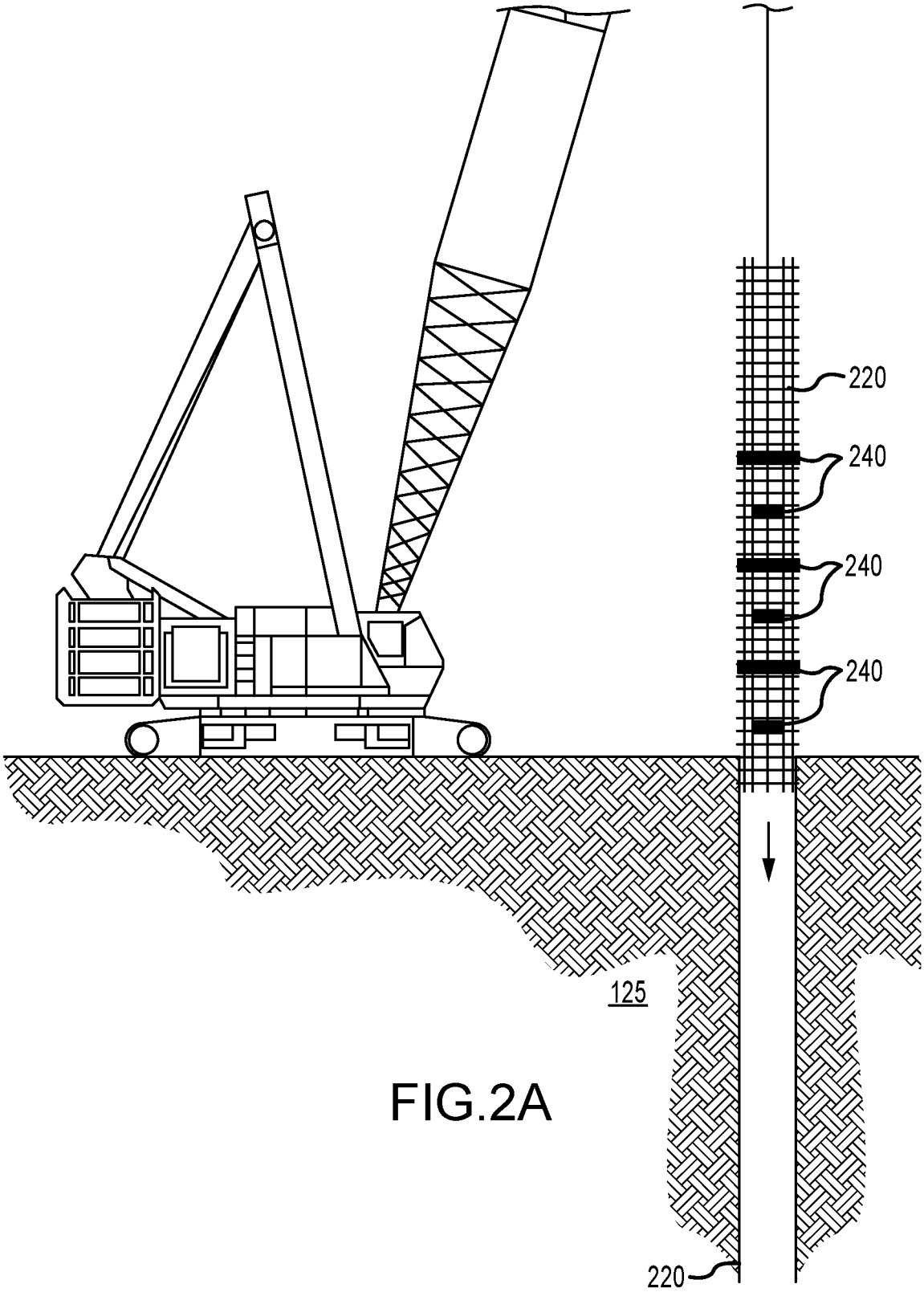
FIGS. 2A and 2B illustrate an exemplar implementation of the lateral substrate support system of the present invention integrated into a rebar cage inserted into a prepared shaft.
Figure 2B:
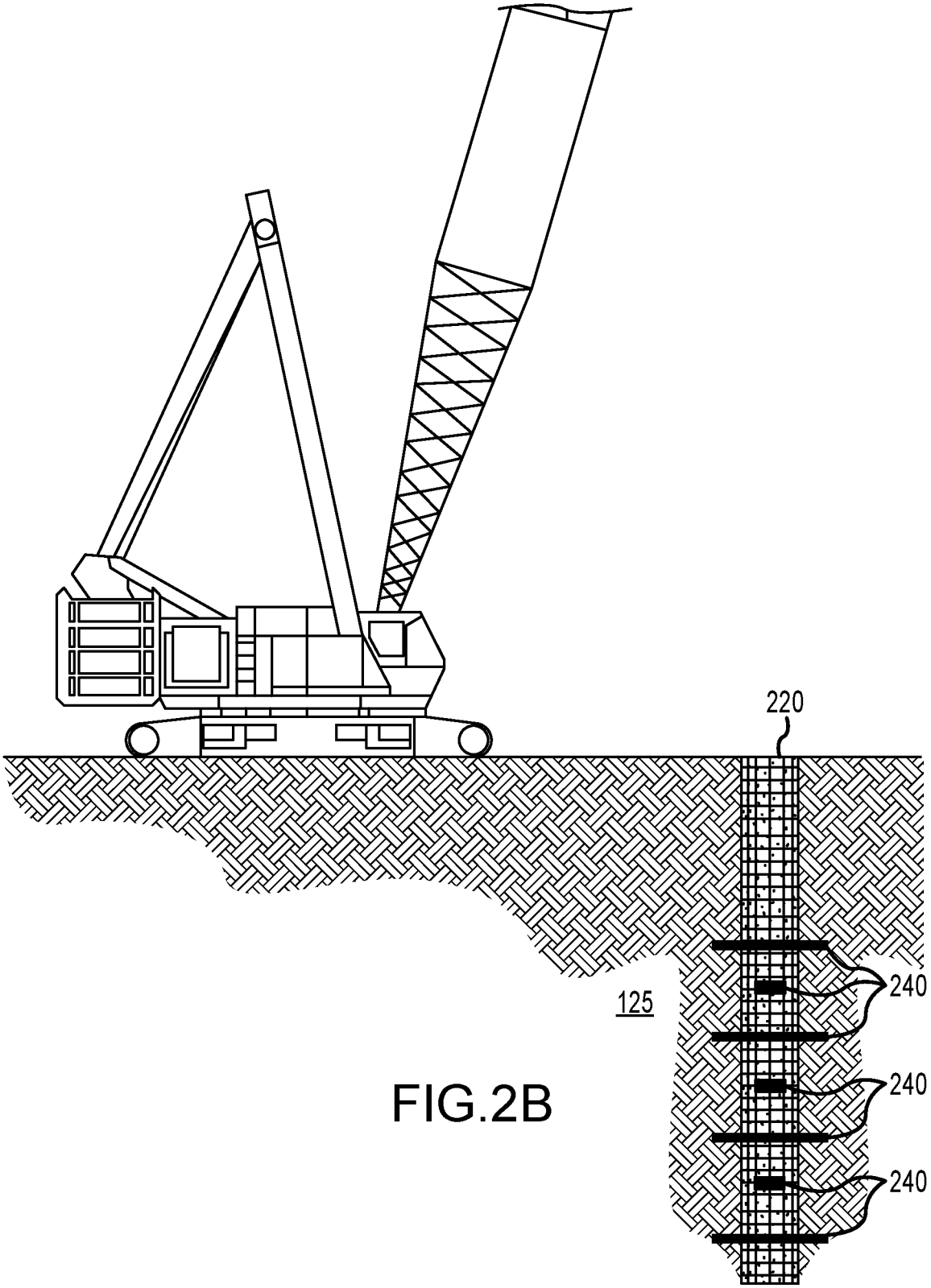

With reference to FIGS. 2A and 2B, an example procedure for installing extensible components of the present invention in a drilled shaft is depicted. In this instance the drilled shaft 210 that is created by conventional methods. A similar conventional process is followed for driven pile applications shown in FIG. 2C. FIG. 2A depicts installing the rebar cage 220 with extensible components 240 integrated within the rebar cage 220 at, in this example, 4 locations in a non-extended configuration. The layout and spacing of the extensions is determined based on the soil stratification and characteristics. The preparation of the rebar cage 220 is as would be known to one of reasonable skill in the relevant art except for the inclusion of a plurality of expansion mechanisms and extensible components. One of reasonable skill in the relevant art will also appreciate loading on the foundation element with the inclusion of the extensible components of the present invention may be different than that or a normal foundation element. Accordingly, the configuration of rebar may be modified to accommodate new load points. As depicted in FIG. 2B, the rebar cage complete with the expansion mechanisms and extensible components is lowered into the prepare shaft 210.

Once in place within the prepare drilled shaft 210, and as depicted in FIG. 2B, concrete or the like, is poured into the drilled shaft and the extensible components 240 are extended by the expansion mechanism(s) into an extended configuration penetrating the substrate. In some embodiments, extensible components may be fully or partially deployed prior to concreting the shaft. In other embodiments the extensible components are partially or fully deployed progressively during the filing the shaft with concrete. In yet other embodiments, the extensible components are partially or fully deployed after the shaft is filled with concrete, either before or after the hardening of the concrete. One of responsible skill in the relevant art will appreciate the timing of when each extensible component is deployed may vary based on several factors including construction methods, soil conditions and soil state.

Figure 2C:
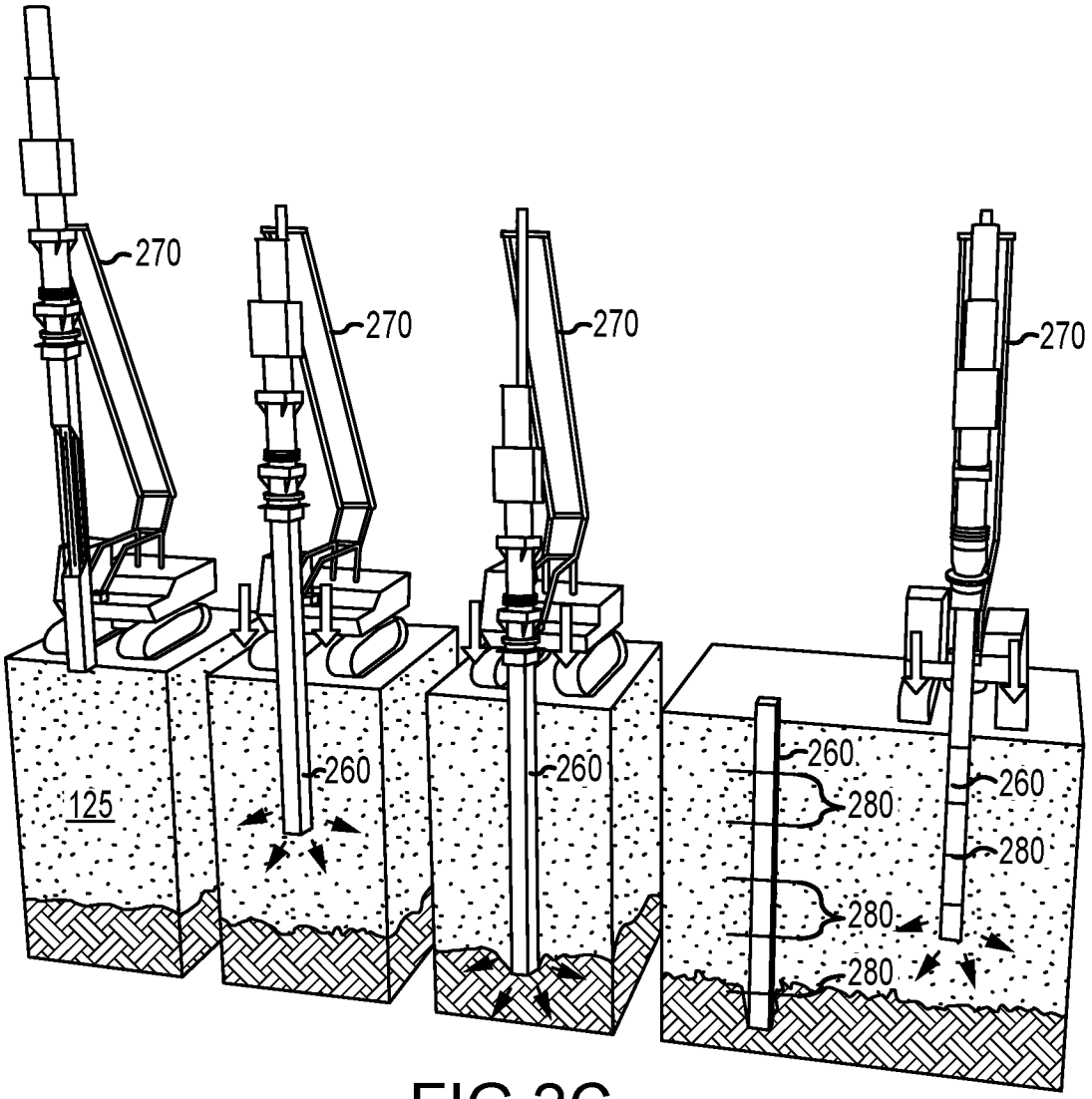
FIG. 2C illustrates an exemplar implementation of the lateral substrate support system of the present invention integrated into piling inserted/driven into the soil/substrate incorporating a plurality of lateral substrate support systems of the present invention.

FIG. 2C presents an example procedure for deploying the foundation element support systems of the present invention in a piling. Unlike a drilled shaft wherein a rebar cage is placed within the excavated hole and the foundation element formed in situ, pilings 260 and the like are prefabricated and driven into the soil using a hydraulic press, driver 270, or fluid suspension. As with the rebar cage shown in FIGS. 2A and 2B, the pilings in FIG. 2C can be prefabricated with integrated expansion mechanisms and extensible components 280 within. Once driven into the ground the extensible components can be deployed, increasing the lateral interaction of the foundation element 260 with the surrounding substrate 125.

Figure 3A:
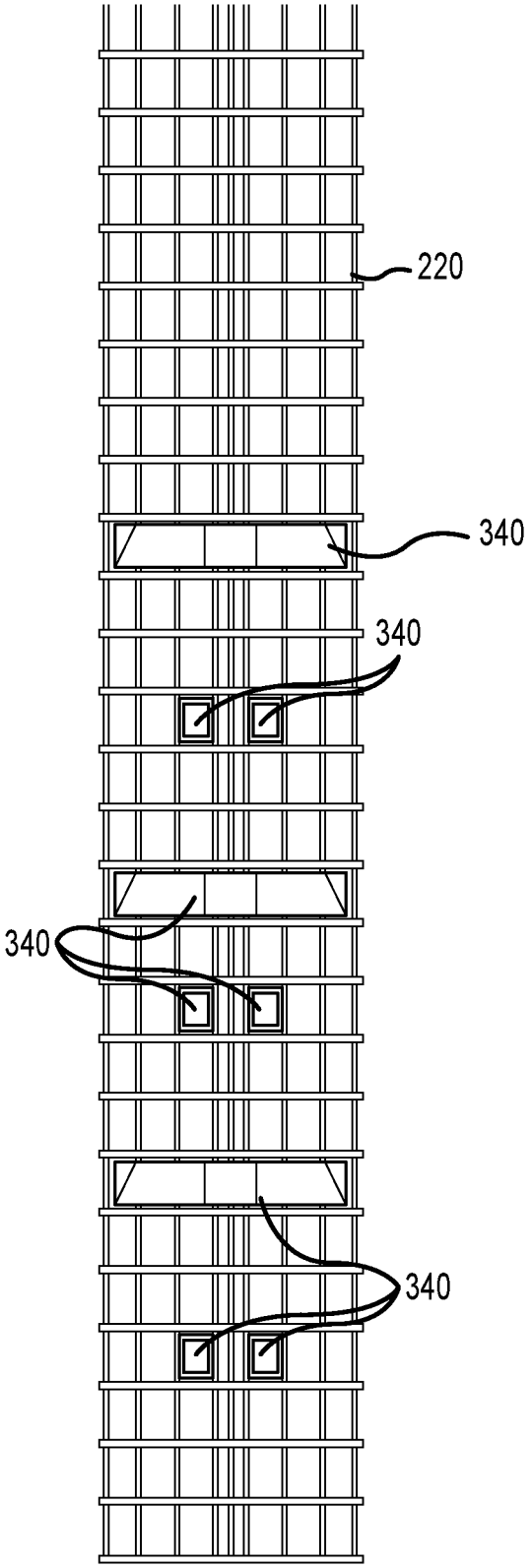
FIGS. 3A and 3B present a side view of an exemplary rebar cage with a plurality of mounted support systems, and a cross-sectional top view, respectively, of one embodiment of the lateral substrate support system of the present invention having 8 symmetrical points of interaction with the substrate.
Figure 3B:
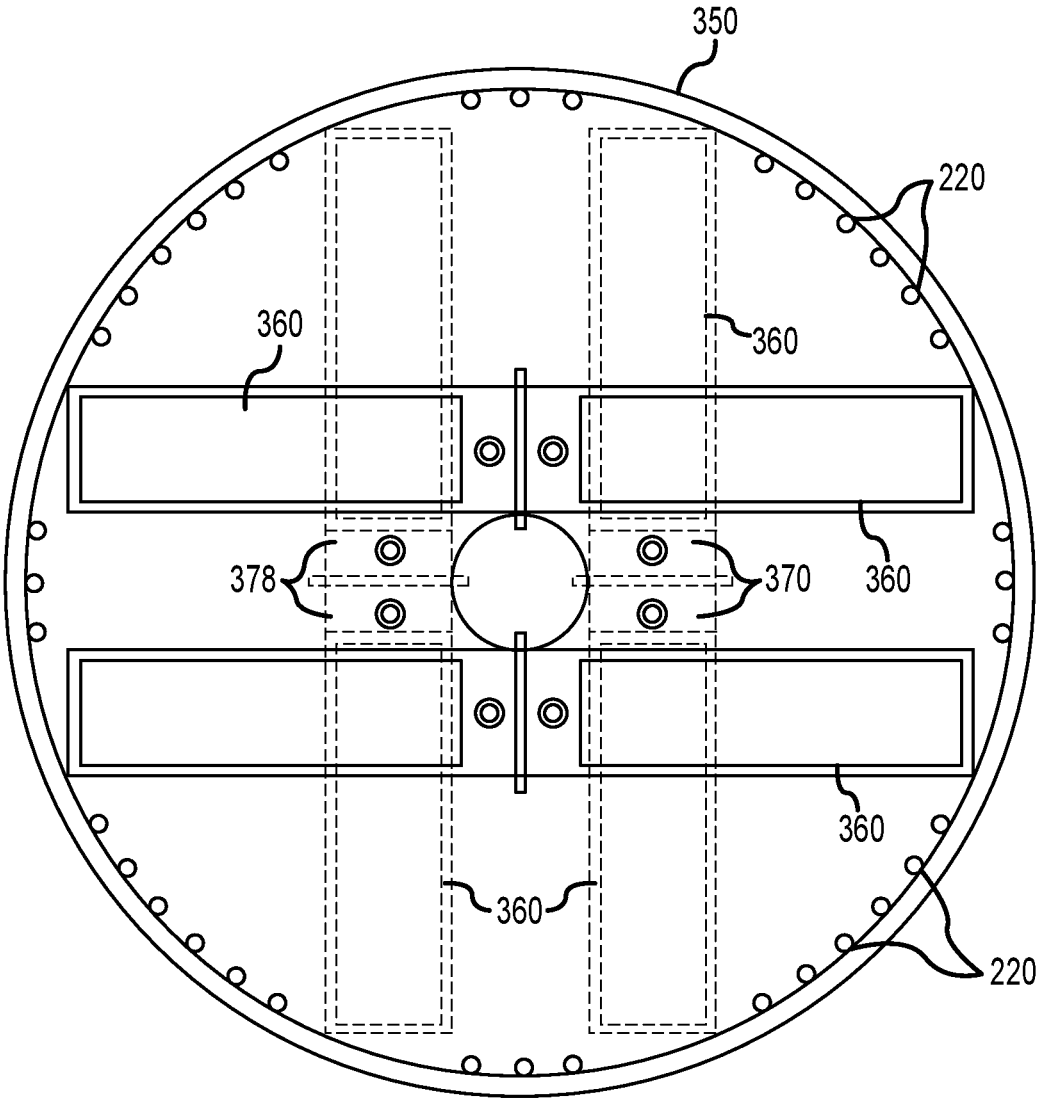

FIGS. 3A and 3B provide additional detail of a rebar cage and one embodiment of a system for support of a foundation element. One of reasonable skill in the relevant art will recognize that prefabricated pilings and the like will possess many similar features of the present invention as illustrated, in this example, with respect to a rebar cage 220 configuration. FIG. 3A presents a side view of an exemplary rebar cage with a plurality of mounted support systems 340. In most instances, a rebar cage 220 like that shown in FIG. 3A is inserted into a drilled shaft prior to backfilling the shaft with concrete or other material. The rebar cage has, in this embodiment, a plurality of support systems 340 spaced at various intervals. In this example there are six support systems positioned within the lower portion of the rebar cage. Three of the systems includes pairs of extensible components oriented so that they would extend in and out (penetrate) of the page in the drawing into surrounding substrate. Other pairs are oriented at right angles so that they would extend to the right and left of the foundation element as depicted. The support systems 340 are shown alternating in orientation and spaced at regular intervals along the length of the rebar cage 220. However, pairs of extensible components having the same orientation can be located adjacent to each other, and spacing may be adjusted to, for example, place more quill pairs at one end or the other of the rebar cage as conditions dictate.

FIG. 3B provides a top view of a cross-section the rebar cage 220 as installed in a drilled shaft (not shown) within a casing 350. Two sets of extensible components 360 and their associated expansion mechanisms 370 are also depicted. As shown, the 90-degree overlapping orientation is apparent. At the center of each extensible component pair are actuators (expansion mechanism) 370 for deploying the extensible components 360 into the surrounding substrate. While in this example the extensible components are shown as pairs and are oriented at 90 degrees to each other, they may be oriented at greater or lesser angles. For example, extensible component pairs may be oriented so that a stepped spiral is formed down the length of the piling, or other suitable orientation scheme. Spacing and orientation can be preset, modular, or custom designed for a particular construction project.

Figure 4A:
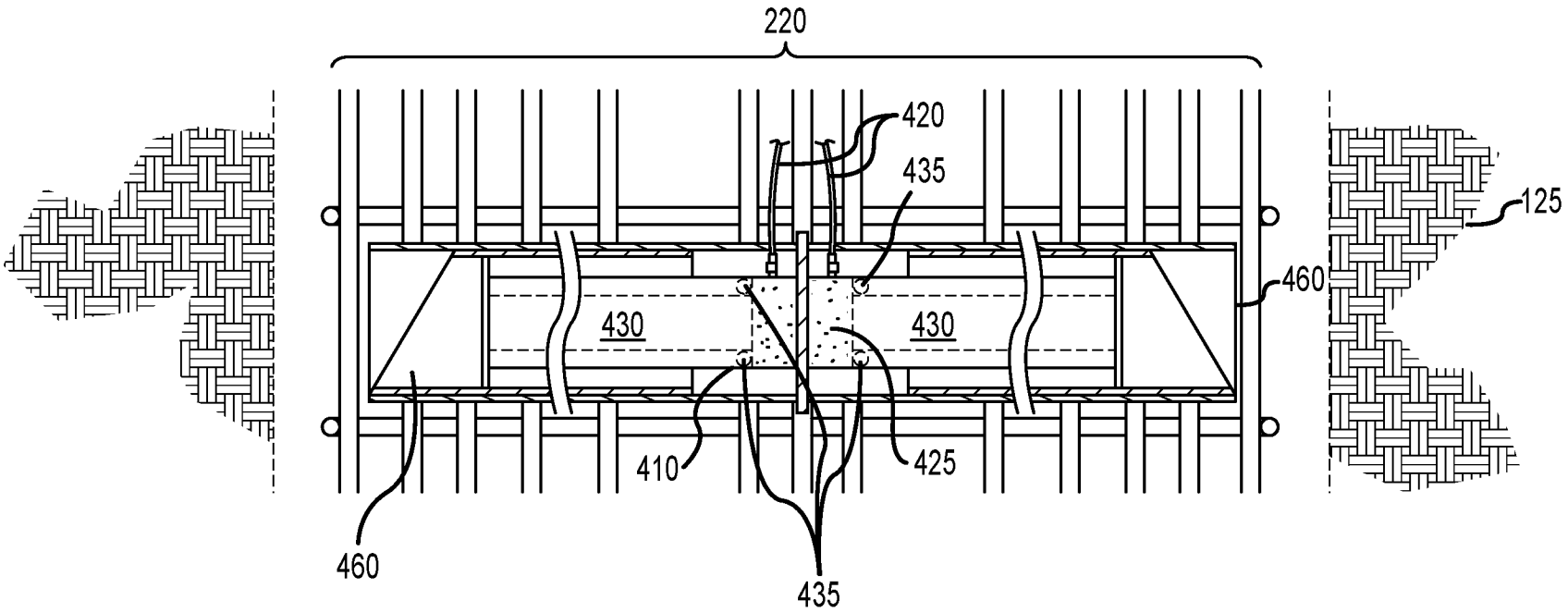
FIGS. 4A-4F presents various views of a fluidic based expansion mechanism of the lateral substrate support system of the present invention showing differing positions of deployment.
Figure 4B:
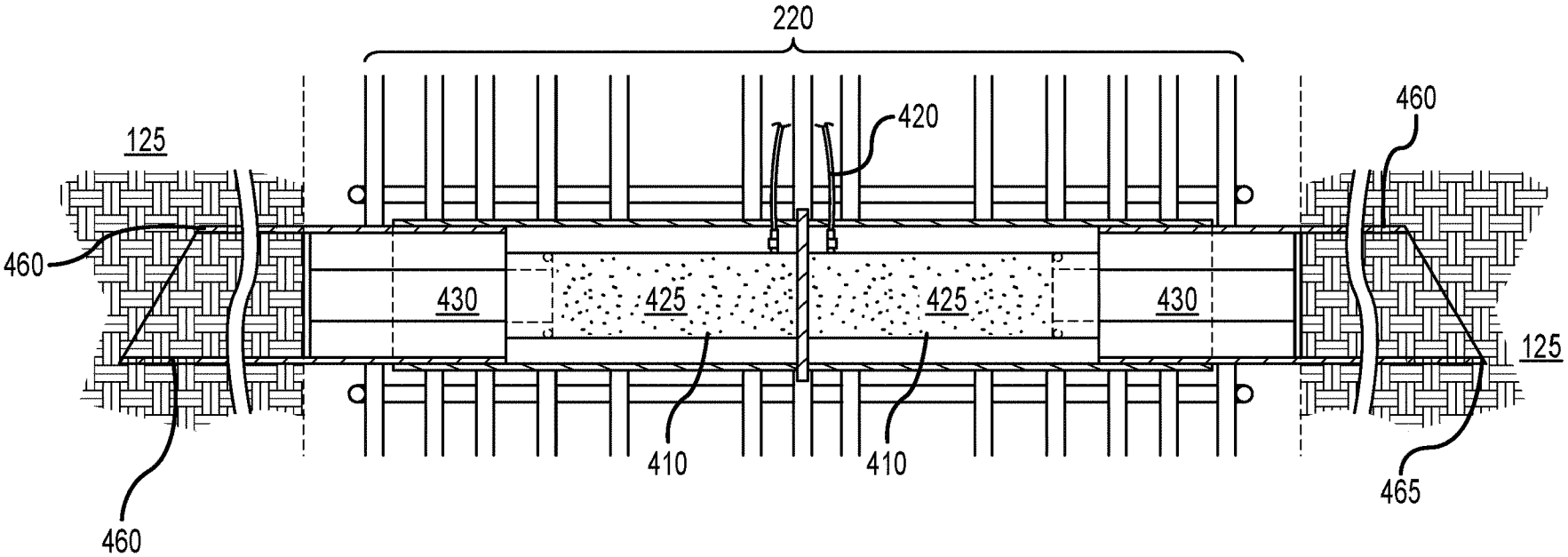
Figure 4C:
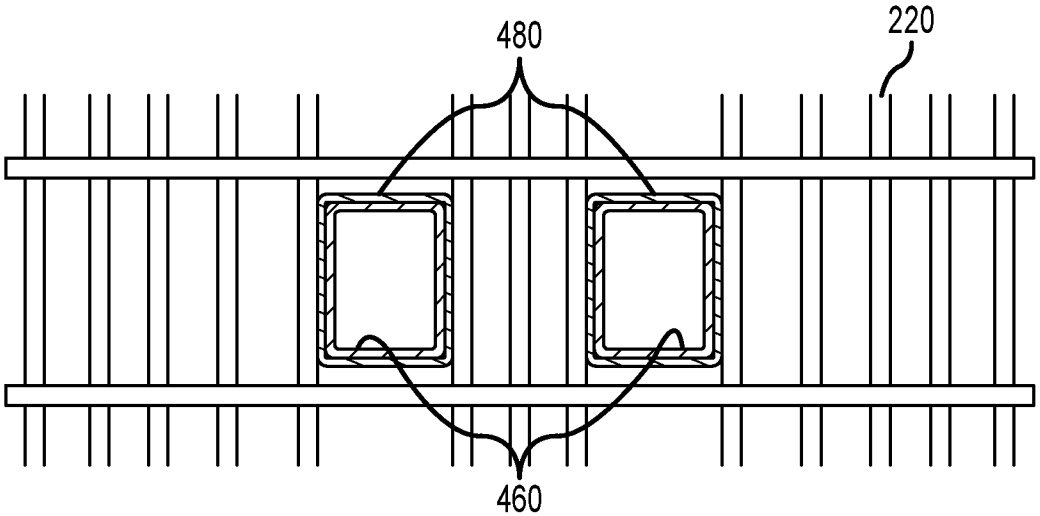
Figure 4E:
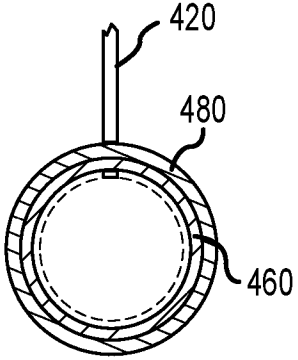
Figure 4D:
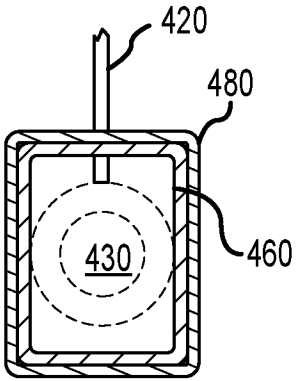
Figure 4F:
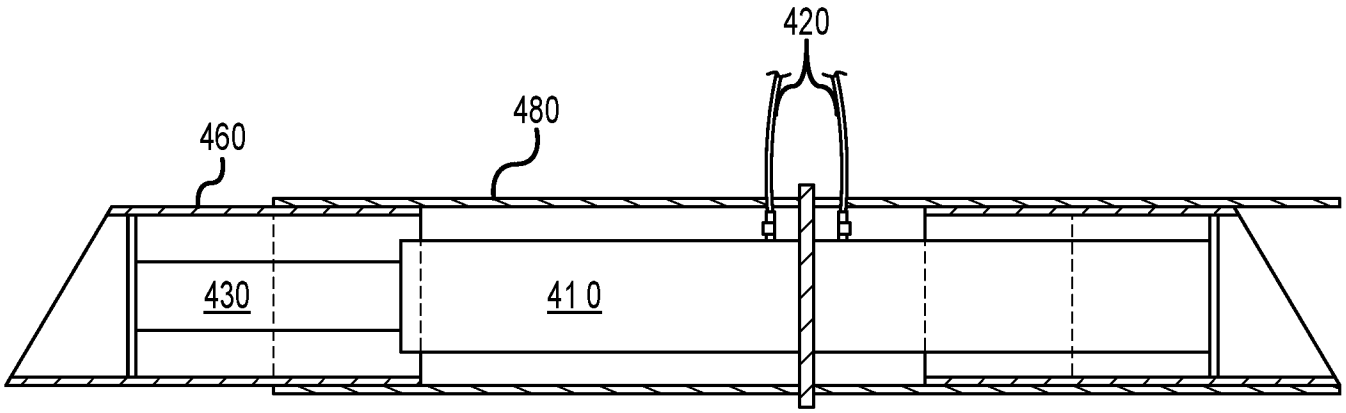

FIGS. 4A through 4E provide additional detail of a support for a foundation element, according to one embodiment of the present invention. FIGS. 4A-4C and FIG. 4F are side views of a support system housed within a rebar cage as would be found in a foundation element. FIGS. 4D and 4E are end views of two embodiments of nested extension components. With reference to FIGS. 4A and 4B a symmetrical configuration of opposing extensible components 460, according to one embodiment of the present invention, is shown. Assemblies of this type can be secured in and to the rebar cages 220, to the post tensioning strands, special frames, support frames, or to a combination of the above. In the pre-extended configuration shown in FIG. 4A, the support system is housed within the exterior dimension (outside limit) of the rebar cage. Rebar of various configurations are shown for reference but one of reasonable skill in the relevant art will appreciate the actual location of rebar may vary depending on design considerations.

In the configuration shown in FIG. 4A a central pressure vessel 410 or chamber is coupled to one or more fluidic sources. The fluidic source are routed through the casing via pressure lines to a pressure source (not shown). In one instance the fluid lines are coupled to a pump or other type of pressure source. In this example, a piston 430 or the like resides within the pressure vessel 410 forming an area in which fluid 425, under pressure, can be delivered via the pressure lines. A pressure seal 435 is formed between the piston 430 and the inner surface of the pressure chamber 410. The piston 430 is coupled to an extensible component 460 suitable for and configured for penetration into the substrate 125. As fluid 425 is introduced into the pressure chamber 410 pressure builds causing the piston 430 to be displaced thereby pushing the extensible component 460 laterally out of the casing and into the surrounding substrate 125. In FIG. 4B an extensible component 460 includes an end fixture 465 (tip) suitable for penetration into the substrate 125 through the outer casing. The extensible component 460 and interior piston 430 extends outward until either the pressure is matched by the resistance exerted by the substrate 125 or the piston reaches a full extension stop. In the instance shown in FIG. 4B the extensible component 460 has been displaced outward into the substrate 125 but has yet to reach the extension limit. FIG. 4B also illustrates a symmetrical deployment of two extensible components 460. While the deployment in this instance is shown to be equal on both sides the actual penetration of each extensible component may vary based on the resistant exerted by the substrate, assuming a constant/maximum pressure within the pressure vessel. Conversely each pressure vessel 410 may be independently controlled to manage pressure to achieve substantially equal displacement albeit with varied pressure. The configuration of various hydraulic components and mechanisms are wildly known and will be readily appreciated by one of reasonable skill in the relevant art. Accordingly, they are not further discussed here but are fully contemplated as being integrable with the present invention.

The extensible components 460 are extended to an extended configuration into the substrate 125 in FIG. 4B by creating a displacement pressure through fluidic means. The fluid used to create the pressure may be water, hydraulic fluid, grout, or any similar incompressible fluid. In other instances, compressed air may be used or even a chemical reaction that results in a high expansive gaseous environment. Pyrotechnics are also a contemplated means by which to drive the extensible components into the substrate. Similarly, the extensible components may be driven into substrate by electrical, electromechanical, or electromagnetic forces. Lastly a mechanical means may be used to reposition the extensible component into the substrate. For example, the exterior portion of the extensible component can be coupled to an interior portion by a screw jack or a threaded coupling. The interior portion can be rotated, translating the exterior portion of the extensible component into the substrate until a specified amount of torque is reached or the component is fully extended. To optimize performance of the support system for a particular application, some embodiments have extensible components that enter the substrate orthogonal to the foundation element, while in other embodiments the extensible component enters the substrate at an angle. The degree of rigidity between the extensible component and foundation element may be varied depending on the application as may the angle at which the extensible component are oriented with respect to the foundation element.

FIG. 4C shows a side view of a side-by-side configuration of a support system for a foundation element. In the embodiment shown in FIG. 4C two interior, substantially rectangular extensible components 460 are extended out of the page. In this embodiment an inner extensible component 460 is nested within an outer extensible component 480. The outer dimension/outer surface of the inner extensible component 460 mates within the inner dimension/inner surface of the outer extensible component 480. With respect to the expansion mechanism described in FIGS. 4A and 4B, as pressure builds within the pressure chamber, the inner extensible component 460, telescopes out of outer extensible component 480 to penetrate the substrate 125. FIG. 4D provides an enlarged cross-sectional view of the relationship between the inner 460 and outer 480 extensible components. One of reasonable skill in the relevant art will appreciate other geometric shapes can be employed, and are indeed contemplated, without departing from the scope of the present invention.

FIG. 4E is a side view of an independent configuration of a support system for a foundation element, according to one embodiment of the present invention. As illustrated in FIG. 4E each expansion mechanism 410, 430 and associated extensible components 460, 480 can, as shown in this instance, operate independently. In other instances, the expansion mechanism can operate in concert to deploy extensible components concurrently. In this instance, two pressure chambers 410 are depicted with the one on the left illustrated displaced extensible component(s) 460 and the one on the right, showing a collapsed/pre-deployment configuration.

Once deployed, the extensible component may be post-grouted to increase strength and load bearing capacity. The grout material could be cementitious, polymer, epoxy, composite, or other suitable material. Grouting may be performed using an independent grouting system or by using the hydraulic jack/actuator (expansion mechanism) system. Post-grouting improves load bearing capacities by creating a bulb at each (or some) of the extensions to further consolidate the soil in that area, increase the effective influence area of the extension, fill any voids around the extension, and/or provide enhanced corrosion protection. These features increase foundation element capacity and durability. When using hollow extensible components, the components may be structurally reinforced and/or have preinstalled rebar in the void prior to deployment and grouting. Finally, the deployment of the extensible components is monitored and confirmed by pressure monitoring, volumetric analysis, sensors, by instrument measurements, and/or by other suitable means.

A wide variety of configurations are possible and contemplated to optimize the lateral support system of the present invention for the required application. For example, the extensible components may be constructed of metal, fiber, carbon fiber, fiberglass, plastics, polymers, or other suitable materials. Some applications may benefit from more rigid extensible components, i.e., steel, and others from more flexible extensible components, i.e., fiberglass, to optimize horizontal or vertical load bearing capacity. The cross sections of the extensible components may also be configured to optimize performance and improve friction. Extensible component may be barbed for easy insertion into the earth and increasing the effective capacity when fully expanded and deployed. Various surface treatments for each extensible component may be used, such as ridges or fins. Different combinations of shapes, materials, or surface treatments may be used to optimize performance for a particular application. And the orientation of each extensible component as it interacts with the substrate may vary based on the design requirements. Indeed, the interaction of the extensible components and the substrate is a critical consideration. Post grouting, the interaction between the extensible component and grout bulb or region must provide a certain degree of movement to share loading subjected to the foundation element. The degree of movement varies based on the application and the composition/characteristics of the substrate. In some instances, the extensible components may be perpendicular to a longitudinal axis of a foundation element while in other embodiments the extensible components may penetrate the substrate at various angles to enhance and optimize the foundation element's load bearing capacity.

Figure 5A:
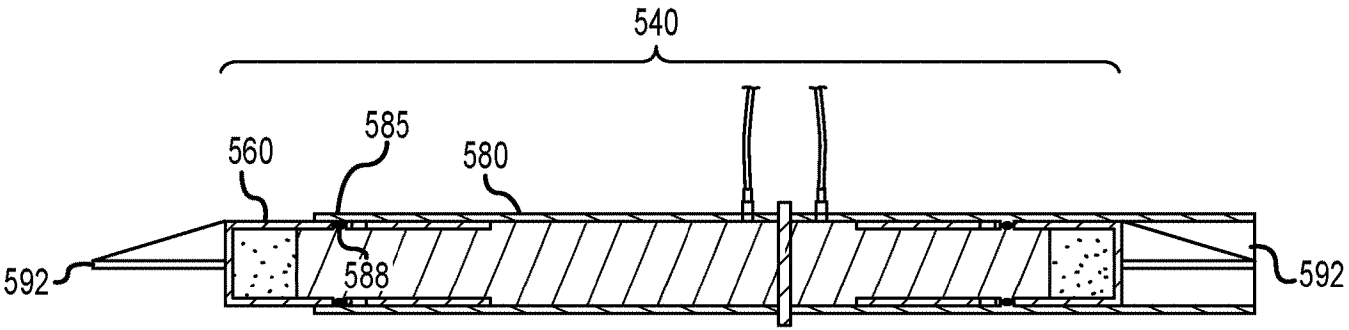
FIG. 5A provides a side cut away view of a symmetric configuration of a lateral substrate support system according to one embodiment of the present invention in which the left side shows the extensible component in an extended configuration and the right side shows the extensible component in a non-extended configuration.
Figure 5B:
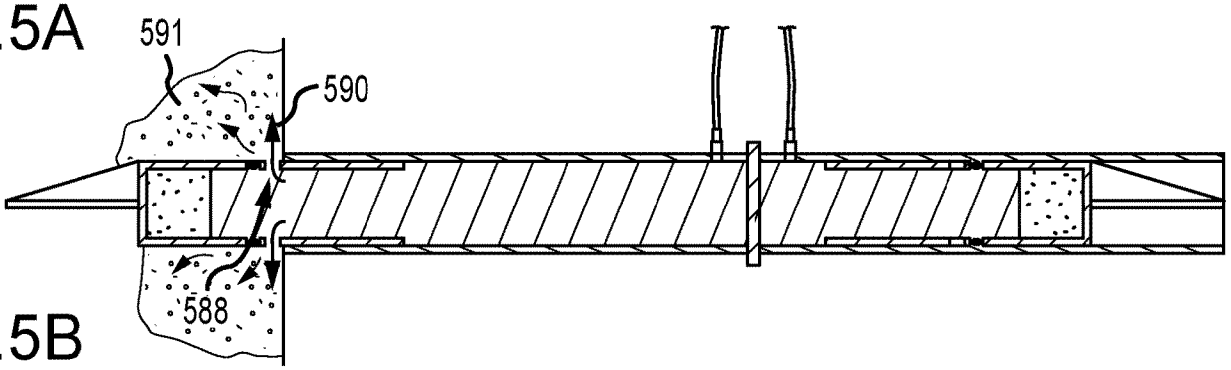
FIGS. 5B and 5C show a plurality of extensible component tip options according to one embodiment of the present invention.

FIGS. 5A and 5B illustrates another mechanism for grouting the extensible components and various forms of the extensible component tips post penetration into the substrate. As discussed herein, post penetration of the extensible component 560 into the substrate, a grout 590, comprised of cement, polymer, or similar material, may be infused into the area surrounding the extensible component and the foundation element. As the grout interacts with the substrate it fills in and occupies voids 591 between substrate particulates. For example, significant space exists between individual grains of sand. The grout occupies this area forming a bulb or region surrounding the extensible component. As the grout solidifies it enhances the interaction between the substrate and the extensible component. In an instance in which the substrate is below the water line and space between particulates of the substrate are occupied by water, the grout replaces the water again increasing the interaction between the extensible component and the substrate. FIG. 5A is a side view of telescoping extensible components 560, 580 of a foundation element support system 540 of the present invention. The support system 540 on the left side of FIG. 5A is shown in a deployed position while the support system 540 on the right side of FIG. 5A is collapsed in the pre-deployment configuration. Each side of the foundation support system is configured with an angular tip 560 to aid in penetration into the substrate.

In this rendition of the foundation support system 540 the extensible components 560, 580 are configured at two telescoping parts with a pressure seal 585 between the exterior dimension/surface of the interior component 560 and the interior dimension/surface of the exterior component 580. In one embodiment a gap exists between the exterior surface of the inner component and the interior surface of the exterior component. This gap or void is filled by a pressure seal (not shown) of a known rating. The seal maintains pressure within the interior area thereby pushing the interior component outward until either a maximum pressure is reached or a mechanical stop is reached. As pressure raises it reaches a point upon which the seal fails. Upon failure of the seal grout flows through the gap between the exterior surface of the inner component and the interior surface of the exterior component into the area or void (void could be air or water) surrounding foundation element, the extension component, and the adjacent substrata forming an area or blub of grout 591. Grout is pumped until either a volumetric or pressure limit is reached. As the grout solidifies, the grout, foundation element and extensible components are rigidly integrated with the substrate.

Another deployment mechanism for the assembly shown in FIG. 5A would be where the extensible components are configured as two telescoping parts 560, 580 with one or more pressure seals 585 between the exterior dimension/surface of the interior component 560 and the interior dimension/surface of the exterior component 580. A series of holes 588 or similar voids are drilled/established in the interior component 585 near the leading seal. Pressure is applied to the system and the interior component is extended into the adjacent soil. Once the interior component 560 is extended to a point where the leading seal 585 is past the leading edge of exterior component 580, the predrilled holes 588 in the interior component are exposed and the grout material 590 can be pumped into the adjacent soil 125. The grout 590 is pumped into the area or void (void could be air or water) surrounding foundation element, the extension component, and the adjacent substrata. Grout is pumped until either a volumetric or pressure limit is reached. As the grout solidifies, the grout, foundation element and extensible components are integrated with the substrate. The system could be first pressured by water during the deployment stage and later switched to grout material (or other material) for the grouting phase.

Figure 5C:
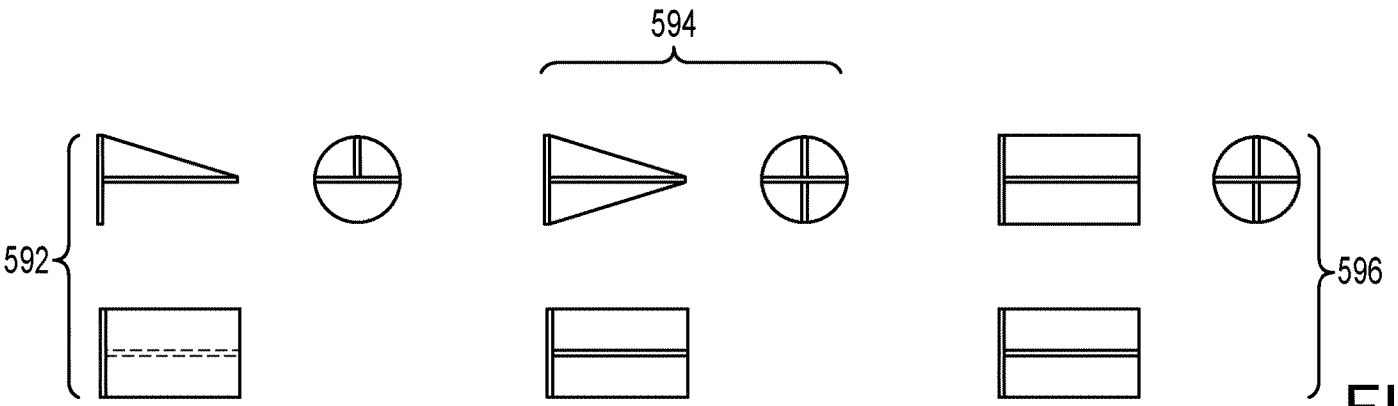

FIGS. 5B and 5C show an exemplar collection of extensible component tips 592 suitable for penetration into the surrounding substrate, according to one embodiment of the present invention. Each configuration of the tip provides a different mechanism for substrate penetration and load transference and selection is based on substrate composition/characteristics and the capacity of the expansion mechanism. Each image provides a side, top and an end view of the tip. The selection of each tip positioned on the end of the extensible component 560/580 is driven, primarily, by substrates characteristics and anticipated design loads. The left most tip presents a T shaped tip 592 with the cross bar of the T spanning the diameter of the extensible component dividing the cross-sectional area of the extensible component into three sections. The crossbars taper to a point to aid in substrate penetration. The middle example of an extensible component tip 594 is an X design diving the cross-sectional area into four quadrants and again tapering to a point. The last example shows a simar X design 596 having four quadrans but does not taper to a point and rather has a blunt face. As will be appreciated by one of reasonable skill in the relevant art, other shapes to aid in penetration of the substrate are contemplated and deemed within the scope of the present invention.

Figure 6:
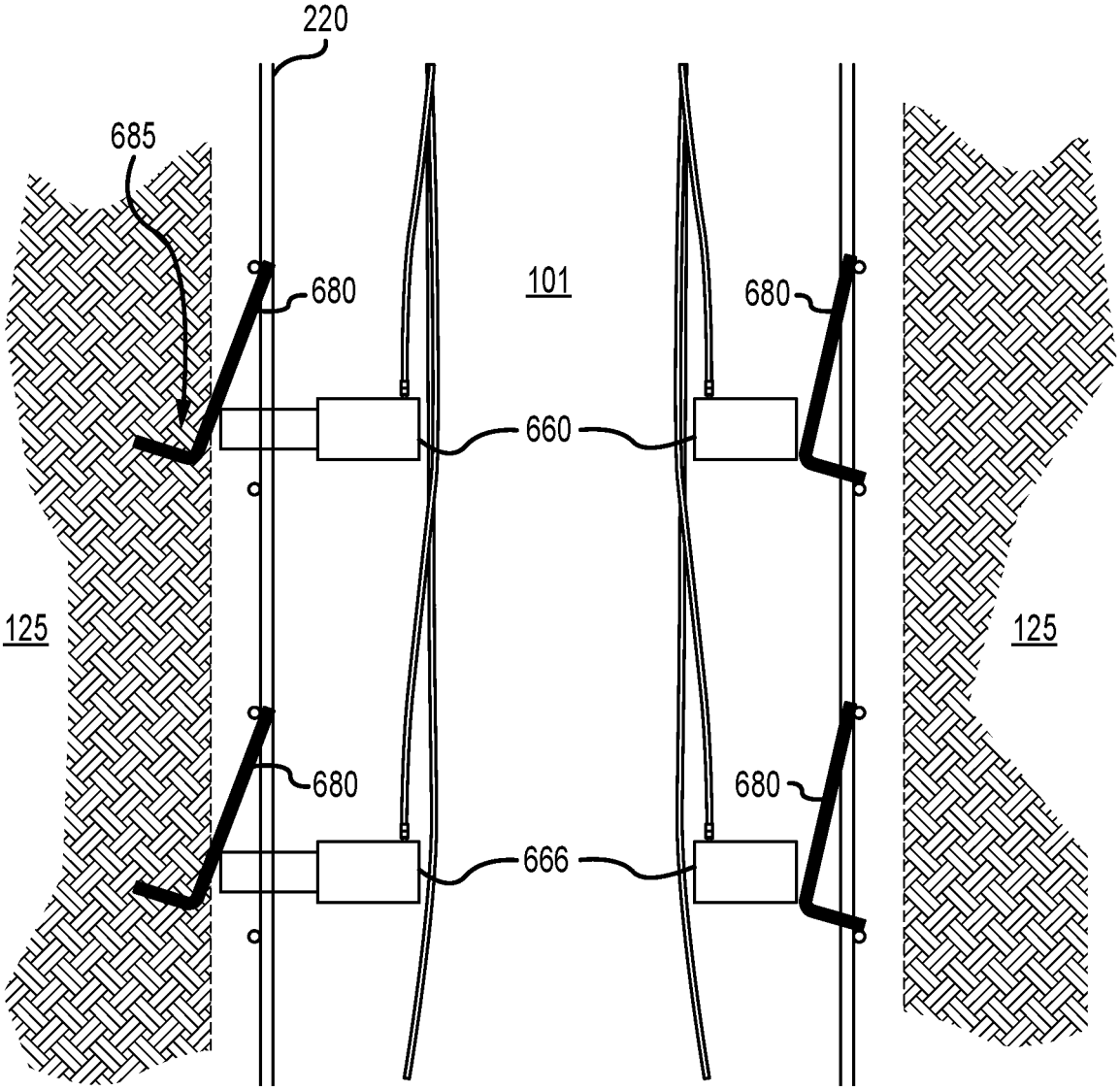
FIG. 6 is a side cut away view of the lateral substrate support system of the present invention illustrating an angular deployment of extensible components (fins) into the substrate.

FIG. 6 presents another embodiment of a foundation element support system according to one embodiment of the present invention. FIG. 6 is a side view of a foundation element comprising a plurality of expansion mechanism 660 and angularly mounted extensible components 680. In this case each extensible component is a "L" shaped fin coupled to an exterior portion of the rebar cage of the foundation element proximate to its exterior surface. Each fin is rotatably coupled such that upon activation of the expansion mechanism 660 the perpendicular portion 685 of the "L" shaped fin extends away from the foundation element 101 and penetrates the substrate 125. The fins on the left side of FIG. 6 present the fins 680 in the extended configuration while the fins 680 on the right side of FIG. 6 show fins prior to deployment. Each fin can be deployed independently or in conjunction with one or more other fins. Similarly, the configuration of the fins along and around the foundation element can vary as can the configuration of the fin itself. Indeed, the fins shown in FIG. 6 can be combined with extensible components (quills) previously described. The deployment mechanism used for the fins can be a variation of the mechanism shown in FIG. 5A. The degree of fixity between the foundation element and the extensible component, be they quills or fins, may vary and be accomplished by mechanical means and/or combinations of shapes and materials.

Figure 7:
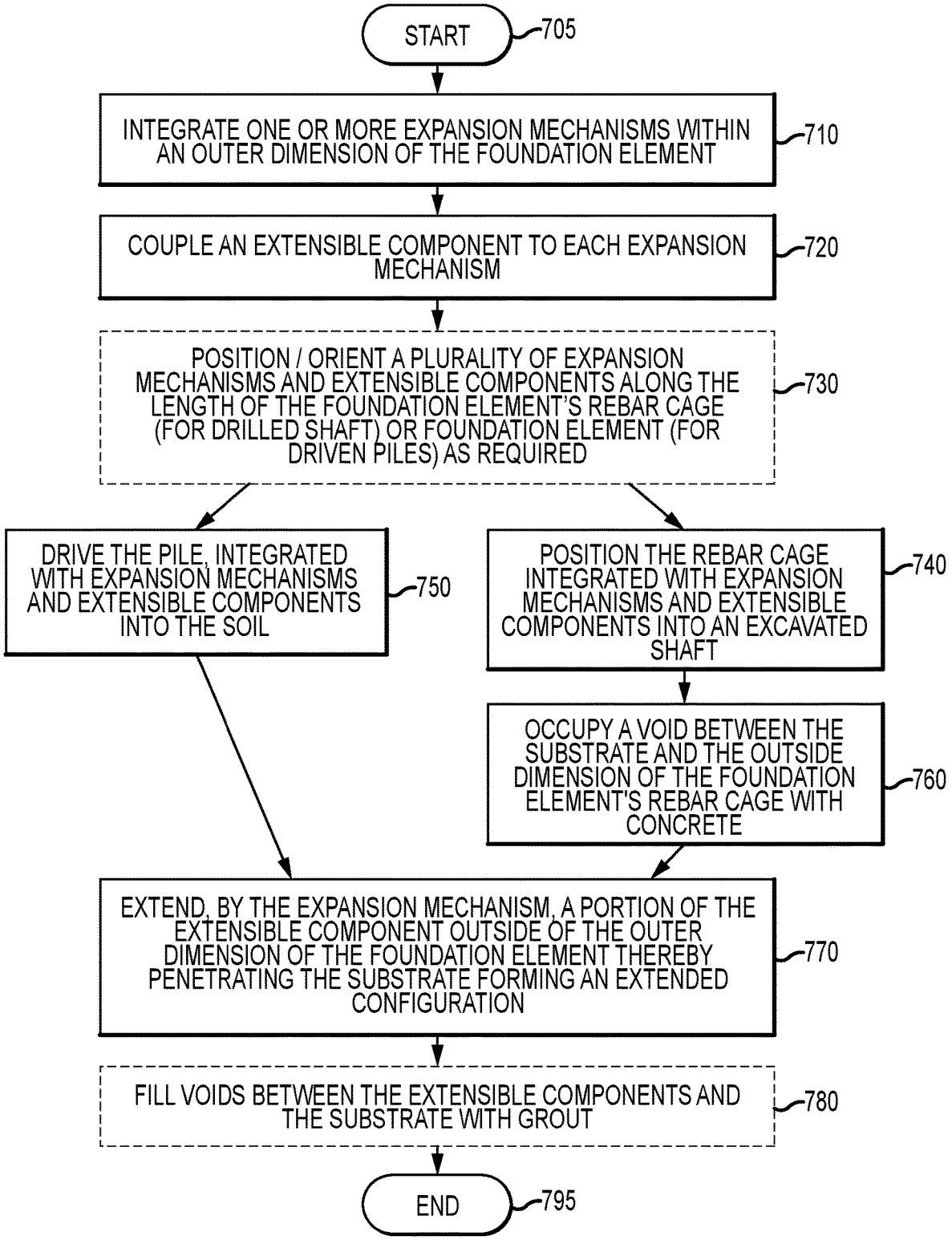
FIG. 7 is a high-level flow chart of one embodiment of a methodology for lateral substrate support of a foundation element, according to the present invention.

According to another embodiment of the present invention, and with reference to FIG. 7, a method for establishing support of a foundation element begins 705 with the establishment 710 of a foundational element within a substrate. As describe herein a foundation distributes the structure's weight throughout the soil to ensure that the structure is properly supported and remains structurally and functionally sound and stable. In many instances foundations include drilled shafts, driven pile, spread footing, screw footings, barrettes, slurry walls, and the like. The foundation element of the present invention relates to both replacement piles (example: drilled shafts) or displacement piles (example: driven piles). The foundation element may, in one instance, include a rebar cage that is lowered into an excavated or drilled shaft which is thereafter filled with concrete or the like, or, in another instance, a prefabricated piling which is driven into a substrate. The present invention is applicable to any foundational element tasked with supporting a particular load.

The present invention integrates one or more expansion mechanisms within an outer dimension of the foundation element. In one embodiment a foundation element positions 730 a plurality of foundation support systems at various locations and orientations along the foundation elements longitudinal axis. As the foundation element is, in most instances lowered into a shaft 740 or driven 750 into the substrate, each expansion mechanisms and associated 720 extensible components, are configured to be within the outer dimension of the foundation element as the foundation element is positioned within the substrate. In the case of a foundation element comprising a rebar cage the exterior dimension is defined by the outermost layer of rebar or similar surface as compared to the size of the shaft in which it is inserted which is therefore filled 760 by concrete.

Based on the load which the foundation element is designed to support, one or more lateral support systems, comprising an expansion mechanism and extensible components, are positioned 730 along the foundation element's longitudinal axis. Each of the expansion mechanisms and the extensible components are sized, shaped, oriented, and located to address a required need of the foundation element. For example, enhancing a foundation elements longitudinal load capacity may require multiple extensible components extending from the foundation element and penetrating a specific substrate at a certain depth and orientation along the longitudinal axis of the foundation element. In instances in which lateral load enhancement is needed, different extensible components may be configured to penetrate another specific substrate at a different depth and orientation along the foundation elements longitudinal axis.

With the rebar cage and extension components positioned 740 within the excavated shaft, or when a prefabricated/precast pile has been driven 750 into the substrate to a predetermine depth, the expansion mechanism extends 770 the extensible components thereby forcing a portion of the extensible component(s) outward thereby penetrating the surrounding substrate and creating an extended configuration of the extensible component(s). In one version of the present invention the extensible components are hydraulically driven into the substrate while in another embodiment the extensible components are extended by the expansion mechanism because of a chemical reaction or expansive gaseous reaction. In yet another embodiment driving the extensible components into the substrate is accomplished via an electrically, electromagnetically, or mechanically driven system.

The size, shape and configuration of the extensible components may vary as may the composition, rigidity, and fixity of each extensible component. The timing of penetrating the substrate by the extensible components may also vary. When a rebar cage is inserted 740 into a drilled shaft, a gap exists between the outer dimension of the rebar cage and the substrate. The rebar cage itself and the gap must be filled with a matrix (concrete) 760 to create the foundation element supportive of a structure. In one embodiment of the present invention, the expansion mechanism extends the extensible components into the substrate prior to filling the foundation element with its matrix such as concrete or the like. In other embodiment the filling of the shaft and foundation element is done concurrently with activation of the expansion mechanism to drive the extensible components into the surrounding substrate. And in yet another embodiment, the extensible components penetrate the substrate after the foundation element are filled with a matrix. The matrix could be still in the fluid stage, soft hardened or completely hardened.

With respect to a piling 750, once the foundation element has reached its desired depth the expansion mechanism integrated within the piling can be activated thereby driving the associated extensible components into the surrounding substrate.

As the extensible components penetrate the substrate a gap or void may exist between the components themselves and the substrate as well as between the outer surface of the foundation element and the shaft/substrate. In one version of the present invention a grout is channeled 780 through expansion mechanism and extensible components (or through an independent network of piping) to fill any void or gap that may exist between the substrate, the extensible components, and/or the foundation element. The grout is distinguishable from the concrete matrix used to form a foundation element in situ. Grout may be more liquid in nature lacking large aggregate and can, in one embodiment, be channeled and directed through the expansion mechanism to interact with the extensible components and substrate. The post grouting could also be used to consolidate the surrounding substrata, increase the effective area of the extensible components, and to provide corrosion protection.

When the extensible components are rotatably coupled to the foundation element, the expansion mechanism drives the extensible component outward thereby rotating the component about its pivot point (fins). A portion of the extensible component penetrates the substrate thereby supporting the foundation element.

The disclosed foundation support system of the present invention provides several advantages over existing foundation elements. These advantages include:

- Universal application: residential, commercial, and infrastructure applications are equally enhanced by the present invention;
- The extensible components once deployed develop higher shaft capacity without increasing piling depth or diameter;
- Extensible components increase mechanical shear, friction, and weight bearing capacities of the foundation elements;
- For a given project, the support system of the present invention reduces the number and size of the foundation elements required;
- The support system of the present invention is applicable to sandy, silty, soft, or cohesive soils;
- No need to excavate down to the bedrock when the needed capacity can be achieved using one or more extensible components;
- The support system of the present invention eliminates the cost of rock sockets if piles no longer need to reach bedrock;
- Smaller and simpler drilling equipment can be used including smaller cranes and hammers to drive the piles and smaller cranes to handle the smaller rebar cages;
- The construction footprint is reduced due to the smaller equipment, and fewer material, and resources need to construct the project.
- The volume of concrete is reduced thereby reducing environmental impact;
- In some instances, the extensible components as a foundation element support may eliminate or reduce rebar cage sizes and splicing requirement; and
- The foundation support system facilitates lower-risk operations: improved worker safety; reduced risk associated with the deep and large foundations; fewer collapses and concreting problems; reduced schedule risk by simplifying and accelerating one of the main critical path activities.

The foundation support system of the present invention enhances the overall capacity of the foundation element. The support system of the present invention does not necessarily need to be deployed on all the foundation elements as needed to improve the capacity of that element. In doing so the foundations can be installed and fabricated quicker, safer, and with lower cost. The reduce size of the foundation elements drives reduced needs for equipment such as cranes and the like and results in lower site congestion at a reduced size construction footprint.

These and other implementation methodologies for supporting a foundation element can be successfully utilized by lateral support system of the present invention. Construction implementation methodologies known within the art and the specifics of their application within the context of the present invention will be readily apparent to one of ordinary skill in the relevant art considering this specification.

The lateral support of the load bearing strata resulting from the deployment of the extensible components of the present invention is also applicable when deployed on foundation elements along the longitudinal axis in an orientation inclined from vertical position.

Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention, as hereinafter claimed.

Embodiments of the present invention and many of its improvements have been described with a degree of particularity. This description has been made by way of example, and that the invention is defined by the scope of the following claims.

While there have been described above the principles of the present invention in conjunction with a foundation element lateral support system and its associated methodology, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

The invention claimed is:

1. A foundation support apparatus, comprising:

a foundation element within a substrate having a length along a longitudinal axis;

an expansion mechanism integrated within an outer dimension of the foundation element;

one or more extensible components associated with the expansion mechanism wherein the expansion mechanism is configured to extend a portion of each extensible component outside the outer dimension of the foundation element to an extended configuration thereby penetrating the substrate, and wherein each extensible components is independently coupled to the expansion mechanism; and an instrument configured to confirm a degree of extension of each extensible component.

2. The foundation support apparatus of claim 1, wherein the longitudinal axis is equidistant from the outer dimension of the foundation element and traverses the expansion mechanism.

3. The foundation support apparatus of claim 1, wherein the longitudinal axis is equidistant from the outer dimension of the foundation element, and the expansion mechanism is offset from the longitudinal axis.

4. The foundation support apparatus of claim 1, wherein the longitudinal axis is equidistant from the outer dimension of the foundation element, and the expansion mechanism is positioned radially from the longitudinal axis.

5. The foundation support apparatus of claim 1, wherein two extensible components are opposingly coupled to the expansion mechanisms.

6. The foundation support apparatus of claim 1, wherein the portion of extensible components is configured to penetrate the substrate at an angle less than 90 degrees as measured from a distal end of the foundation element relative to the longitudinal axis.

7. The foundation support apparatus of claim 1, wherein the portion of the extensible component is configured to penetrate the substrate at an angle greater than 90 degrees as measured from a distal end of the foundation element relative to the longitudinal axis.

8. The foundation support apparatus of claim 1, wherein the extensible component includes an inner component and an outer component and wherein the outer component is hollow having an outer component interior dimension and wherein an inner component exterior dimension is less than the outer component interior dimension, the inner component being movable within the outer component.

9. The foundation support apparatus of claim 8, further comprising a fluid fluidically coupled to the expansion mechanism and channeled to an interior of the outer component thereby creating a pressure gradient translating the inner component within the outer component to the extended configuration.

10. The foundation support apparatus of claim 1, wherein the portion of the extensible components is a rigid element.

11. The foundation support apparatus of claim 1, wherein in an extended state, the portion of the extensible component extends beyond the outside dimension of the foundation element into the substrate.

12. The foundation support apparatus of claim 1, wherein an end of the extensible component is configured based on a composition of the substrate.

13. The foundation support apparatus of claim 1, wherein the foundation element includes reinforcement bars (rebar) configured into a rebar cage and a further comprising a void between the substrate and an outer dimension of the rebar cage and between the reinforcement bars of the rebar cage and wherein a matrix is configured to occupy the void and integrate with the rebar cage responsive to the portion of the extensible component being in the extended configuration.

14. The foundation support apparatus of claim 1, wherein the foundation element includes reinforcement bars (rebar) configured into a rebar cage and a further comprising a void between the substrate and an outer dimension of the rebar cage and between the reinforcement bars of the rebar cage and wherein a matrix is configured to occupy the void and integrate with the rebar cage prior to the portion of the extensible component being in the extended configuration.

15. The foundation support apparatus of claim 1, wherein the foundation element includes reinforcement bars (rebar) configured into a rebar cage and a further comprising a void between the substrate and an outer dimension of the rebar cage and between the reinforcement bars of the rebar cage and wherein a matrix is configured to occupy the void and integrate with the rebar cage concurrent to the portion of the extensible component being placed in the extended configuration.

16. The foundation support apparatus of claim 1, wherein the expansion mechanism are electrically driven.

17. The foundation support apparatus of claim 1, wherein the expansion mechanism are hydraulically driven.

18. The foundation support apparatus of claim 1, wherein the expansion mechanism are mechanically driven.

19. The foundation support apparatus of claim 1, wherein the expansion mechanism are driven by a chemical reaction.

20. The foundation support apparatus of claim 1, wherein responsive to the portion of the extensible components being configured to the extended configuration further comprising a grout configured to occupy an area void of material within the substrate surrounding the extensible components in the extended configuration.

21. The foundation support apparatus of claim 1, wherein the extensible component is a projection proximate to an exterior surface of the foundation element and substantially aligned with the longitudinal axis of the foundation element in a nonextended configuration, the projection having a first end rotatably coupled to the foundation element and a second end associated with the expansion mechanism and wherein in the extended configuration the second end is angularly offset about the first end thereby penetrating substrate.

22. The foundation support apparatus of claim 1, further comprising an extensible component tip wherein a configuration of the extensible component tip is based on substrate composition and/or an expansion mechanism capacity.

23. A method for establishing support of a foundation, the method comprising:

integrating one or more expansion mechanisms within a foundation element;

independently coupling each extensible component to the expansion mechanism;

establishing the foundation element within a substrate wherein the foundation element includes a length along a longitudinal axis;

extending, by the expansion mechanism, a portion of each extensible component outside of an outer dimension of the foundation element thereby penetrating the substrate; and confirming a degree of extension of each extensible component.

24. The method for establishing support of a foundation according to claim 23, wherein the longitudinal axis is equidistant from the outer dimension of the foundation element and further comprising traversing the expansion mechanism by the longitudinal axis.

25. The method for establishing support of an underpinning according to claim 23, wherein the longitudinal axis is equidistant from the outer dimension of the foundation element and further comprising offsetting the expansion mechanism from the longitudinal axis.

26. The method for establishing support of an underpinning according to claim 23, wherein the longitudinal axis is equidistant from the outer dimension of the foundation element and further comprising radially positioning the expansion mechanism from the longitudinal axis.

27. The method for establishing support of an underpinning according to claim 23, wherein coupling includes opposingly coupling two extensible components to the expansion mechanism.

28. The method for establishing support of a foundation according to claim 23, further comprising configuring the portion of extensible components to penetrate the substrate at an angle less than 90 degrees as measured from a distal end of the foundation element relative to the longitudinal axis.

29. The method for establishing support of a foundation according to claim 23, further comprising configuring the portion of extensible components to penetrate the substrate at an angle greater than 90 degrees as measured from a distal end of the foundation element relative to the longitudinal axis.

30. The method for establishing support of a foundation according to claim 23, wherein extending includes electrically driving the expansion mechanism.

31. The method for establishing support of a foundation according to claim 23, wherein extending includes hydraulically driving the expansion mechanism.

32. The method for establishing support of a foundation according to claim 23, wherein extending includes driving by a chemical reaction the expansion mechanism.

33. The method for establishing support of a foundation according to claim 23, further comprising a positioning a plurality of expansion mechanisms and extensible components along the length of the foundation element.

34. The method for establishing support of a foundation according to claim 23, further comprising configuring the foundation element with reinforcement bars (rebar) into a rebar cage, and in situ occupying a void between the substrate and an outer dimension of the rebar cage, and between the reinforcement bars of the rebar cage, with a matrix prior to the portion of the extensible component being in an extended configuration.

35. The method for establishing support of a foundation according to claim 23, further comprising configuring the foundation element with reinforcement bars (rebar) into a rebar cage, and in situ occupying a void between the substrate and an outer dimension of the rebar cage, and between the reinforcement bars of the rebar cage, with a matrix after the portion of the extensible component being in an extended configuration with a matrix.

36. The method for establishing support of a foundation according to claim 23, further comprising configuring the foundation element with reinforcement bars (rebar) into a rebar cage, and in situ occupying a void between the substrate and an outer dimension of the rebar cage, and between the reinforcement bars of the rebar cage, with a matrix concurrent to the portion of the extensible component being placed in an extended configuration with a matrix.

37. The method for establishing support of a foundation according to claim 23, further comprising rotating, by the expansion mechanism, the portion of the extensible component to an extended configuration wherein the extensible component, in a nonextended configuration, is proximate to an exterior surface of the foundation element and substantially aligned with the longitudinal axis of the foundation element, the extensible component having a first end rotatably coupled to the foundation element and a second end angularly offset from the first end thereby penetrating substrate responsive to being rotated by the expansion mechanism.

38. The method for establishing support of a foundation according to claim 23, wherein extending includes occupying by a grout an area void of material between the portion of the extensible components penetrating the substrate and the substrate.

* * * * *